United States Patent [19]

Ito et al.

[11] Patent Number: 4,860,052

[45] Date of Patent: Aug. 22, 1989

[54] COPYING APPARATUS WITH USE FREQUENCY CANCELLATION CONTROL

[75] Inventors: Masazumi Ito, Toyohashi; Kadotaro Nishimori, Toyokawa; Masaaki Oyabu, Aichi, all of Japan

[73] Assignee: Minolta Camera Kabushiki Kaisha, Osaka, Japan

[21] Appl. No.: 95,475

[22] Filed: Sep. 11, 1987

[30] Foreign Application Priority Data

| | | | |
|---|---|---|---|
| Sep. 13, 1986 | [JP] | Japan | 61-216189 |
| Sep. 13, 1986 | [JP] | Japan | 61-216190 |
| Dec. 20, 1986 | [JP] | Japan | 61-305106 |

[51] Int. Cl.[4] ..... G03G 15/00

[52] U.S. Cl. ..... 355/209; 355/308

[58] Field of Search ..... 355/14 CU, 14 SH, 14 R, 355/14 C

[56] References Cited

U.S. PATENT DOCUMENTS

| | | | |
|---|---|---|---|
| 4,496,237 | 8/1982 | Schron | 355/14 C |
| 4,674,862 | 6/1987 | Abuyama | 355/14 R |

FOREIGN PATENT DOCUMENTS

| | | | |
|---|---|---|---|
| 54-29643 | 3/1979 | Japan . | |
| 93466 | 5/1984 | Japan | 355/14 C |
| 128562 | 7/1984 | Japan | 355/14 C |
| 55662 | 3/1986 | Japan | 355/14 C |
| 80170 | 4/1986 | Japan | 355/14 CU |
| 61-88279 | 5/1986 | Japan . | |
| 3261 | 1/1987 | Japan | 355/14 CU |

OTHER PUBLICATIONS

European Published Application; Publication No. 0085975; published 8/17/83; Tadokoro, Hiroyuki; Japan, Eastman Kodak Research Disclosure; Oct. 1974; pp. 57–58.

*Primary Examiner*—Arthur T. Grimley
*Assistant Examiner*—E. J. Pipala
*Attorney, Agent, or Firm*—Burns, Doane, Swecker & Mathis

[57] ABSTRACT

The present invention relates to a copying machine constructed so as to make maintenance, and the replacement period for components in particular, readily understandable. The apparatus includes a first counter which counts the number of copies reproduced and a second counter which counts the use frequencies of the component whose use frequencies are not countable by said first counter.

8 Claims, 28 Drawing Sheets 320
311
302
304
310
305
300
301
313
331
312
303
330
551
530
531
550
511
501
520
512
540
500
502
510
503
541
14
15
M3
13
12
11
SW500
SW501
19
16
M4
18
17
10
3
4
5
6
2
28
27
29
M1
1
9
8
26
30
25
7
24
22
23
SE1
SE2
410
21
21a
20
405~408
401~404
1017
1028
1027
1002
1038
1037
M5
1018
1011~1014
1015,1016
1025,1026
1021~1024
1031~1034
1035,1036
1000
1010
1020
1030
1040
700

| counter NO | object of detector | parts code |
|---|---|---|
| 1 | used number of paper roller 22 | x A |
| 2 | used number of paper roller 30 | x b |
| 3 | used number of paper roller 1018 | x C |
| 4 | used number of paper roller 1028 | x d |
| 5 | used number of paper roller 1038 | x E |
| 6 | used number of non-sort path | x F |
| 7 | used number of sort path | x H |
| 8 | used number of paper roller 302 | x J |
| 9 | used number of unit 330 | x L |

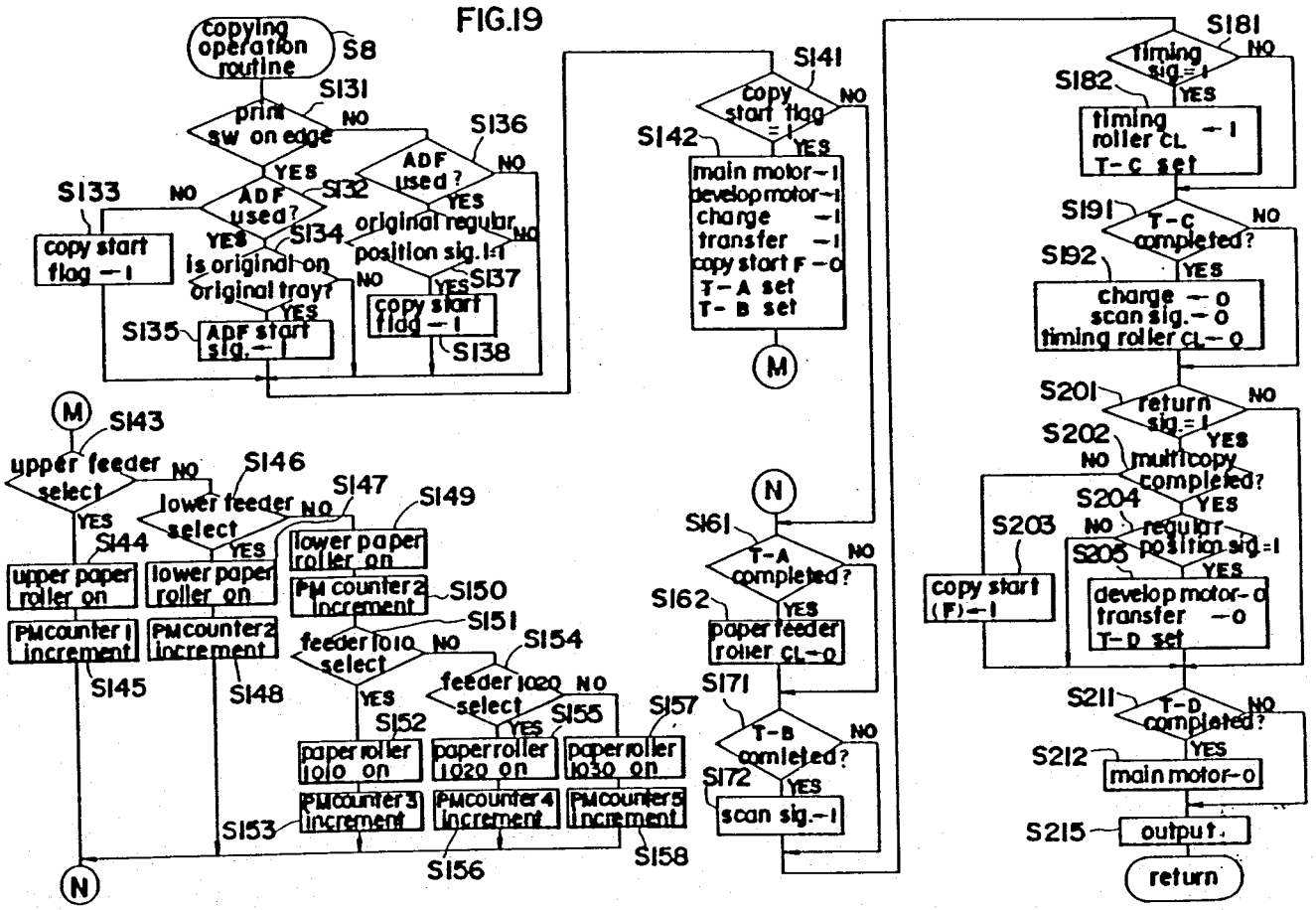
FIG.19
copying operation routine
S8
print sw on edge
S131
ADF used?
S132
ADF used?
S133
copy start flag —1
S134
is original on original tray?
S135
ADF start sig.—
S136
original regular position sig.=1
S137
copy start flag —1
S138
copy start flag =1
S141
main motor—1 develop motor—1 charge —1 transfer —1 copy start F —0 T—A set T—B set
S142
M
N
T—A completed?
S161
paper feeder roller CL—0
S162
T—B completed?
S171
scan sig.—1
S172
upper feeder select
S143
lower feeder select
S144
upper paper roller on
lower paper roller on
PM counter 1 increment
S145
PM counter 2 increment
S146
lower paper roller on
S147
PM counter 2 increment
S148
feeder 1010 select
S149
S150
feeder 1020 select
S151
paper roller 1010 on
S152
PM counter 3 increment
S153
paper roller 1020 on
S154
PM counter 4 increment
S155
paper roller 1030 on
S156
PM counter 5 increment
S157
S158
timing sig.=1
S181
timing roller CL —1 T—C set
S182
T—C completed?
S191
charge —0 scan sig.—0 timing roller CL—0
S192
return sig.=1
S201
multicopy completed?
S202
regular position sig.=1
S204
S205
develop motor—0 transfer —0 T—D set
S203
copy start (F)—1
T—D completed?
S211
main motor—0
S212
output.
S215
return

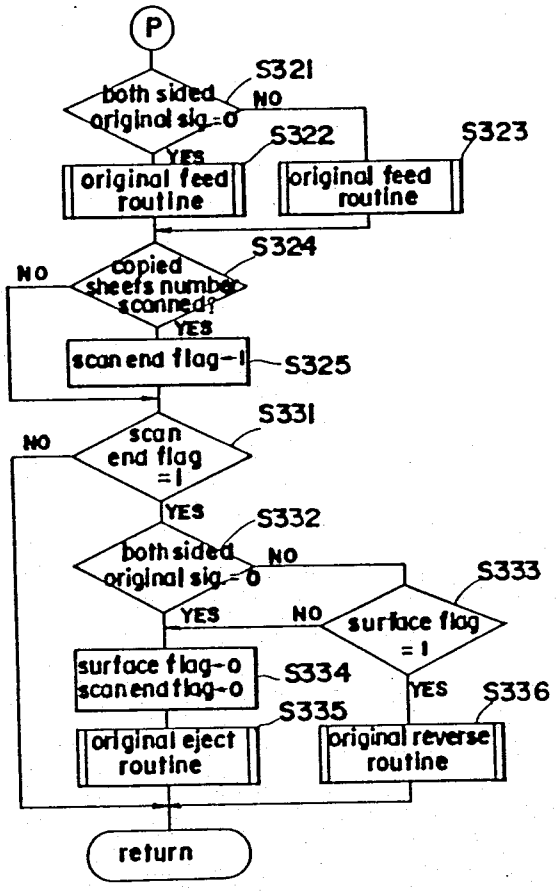
FIG. 22
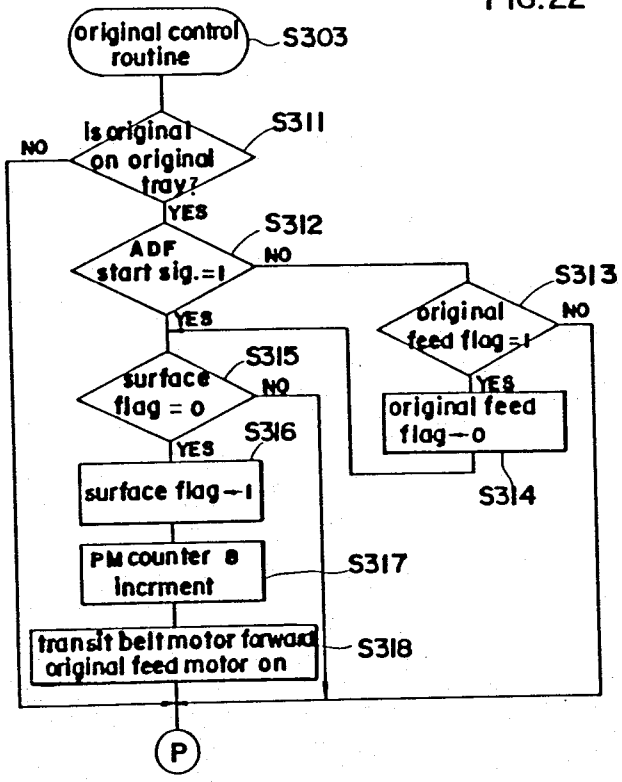

COPYING APPARATUS WITH USE FREQUENCY CANCELLATION CONTROL

BACKGROUND OF THE INVENTION

The present invention relates to a copying machine constructed so as to make maintenance, and the replacement period for components in particular, readily understandable.

In maintaining a copying machine, the consumable components of the copying machine are replaced by new components at the end of each specified service term.

The question of whether or not a component should be replaced can be readily determined for components for which the use frequency of the part and the copy frequency is identical (for example, a photosensitive drum, cleaning blade and developer) by ascertaining whether or not the number of copies has reached a specific value because the use frequency of the component can be determined by a glance at the copy counter.

Electrophotographic copying machines which can make copies on a plurality of paper sizes have copy counters corresponding to the copy size, and which select and increment the copy counter that corresponds to the cassette size.

In order to facilitate maintenance of electrophotographic copying machines, some machines facilitate the verification of the service period by displaying in a display area the use status of each part which should be replaced, and others automatically make the component unusable when a standard use term is exceeded.

Components such as the paper supply roller and the document feed belt for automatic feed devices differ in use frequency depending on the way in which they are used by the operator. The use periods, of these types of components cannot be determined by the total value of the copy counter alone. Heretofore, these components have been replaced, e.g., as the wear condition of the rollers, etc., were determined to be dangerous via visual inspection by service personnel. Of course, the judgement of the service personnel being dependent upon personal experience. In instances such as this, however, components are often replaced more frequently than necessary or, alteratively breakdown when their use is extended beyond the service period.

SUMMARY OF THE INVENTION

A principal object of the present invention is to provide a copying machine for which components having different use frequencies depending upon the operator's method of use can be appropriately maintained by inexperienced personnel.

A further object of the present invention is to provide a copying machine for which the service period for the main components can be readily known and component replacement can be properly performed.

A still further object of the present invention is to provide a copying machine for which the the use frequency of the main components can be calculated when said use frequency does not conform with the copy number, and which does not erroneously erase said calculated value.

The above and further objects, of the present invention are accomplished by means of a copying machine comprising the features described hereinafter.

A copying machine of the present invention includes a first counting means for counting the number of copies, and a second counting means for counting the use frequencies of components whose use frequencies are not tabulated by the aforesaid first counting means.

For example, the aforesaid components are a plurality of paper supply sections from which paper is moved to the transfer area; the aforesaid second counting means counts the frequency with which paper is supplied from each of the respective paper supply sections; the aforesaid components are a plurality of paper transport means which transport the copy-bearing paper to a plurality of paper tray sections; the aforesaid second counting means counts the frequency with which paper is transported by each of the respective paper transport means; the aforesaid component is an original document supply means which moves the document to an exposure position; the aforesaid second counting means counts the frequency with which paper is supplied by said original document supply means; the aforesaid component is an original document inverting means which inverts the original that has been moved to the exposure position; the aforesaid second counting means counts the frequency with which originals are inverted by the original document inverting means.

A modified form of the present invention is constructed in such a way that the calculated value of said second counting means cannot be erroneously erased (i.e., the modified form of the invention is characterized in that it provides a memory means which saves the calculated value of said second counting means), and comprises a clearing means which clears the calculated value of the second counting means, clear indicator means which indicates clearing of the calculated value of the second counting means, cancellation display means which displays the cancelled clearing of the calculated value of the second counting means, and a clearing control means which restores the saved value to the second counting means following the cancellation of the clearing operation which is indicated by the cancellation display means after the clearing display indicates the clearing operation has been performed and the calculated value is saved in the memory means.

BRIEF DESCRIPTION OF THE DRAWINGS

FIG. 19 is a flow chart showing the subroutine for copy operation.

FIG. 22 is a flow chart showing the original document control subroutine.

DETAILED DESCRIPTION OF THE INVENTION

(a) Copy Machine Construction

Figure 1:
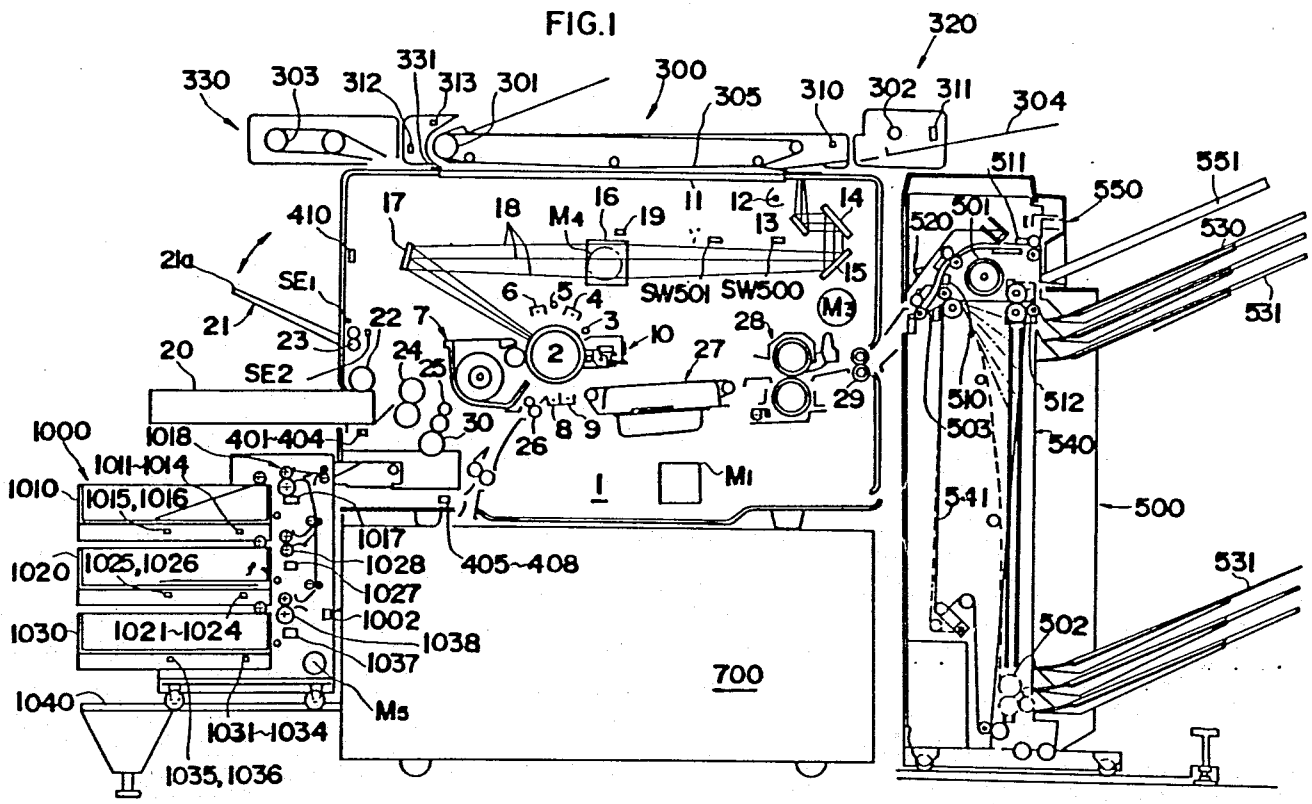
FIG. 1 is a cross sectional view of a copying machine embodying the present invention.

FIG. 1 shows a schematic cross sectional view of an electrophotographic copy machine related to the present invention. This electrophotographic copy machine comprises a a copy machine 1, a platform 700 upon which said copy machine 1 is provided, original document auto feeder (ADF) provided as an option, triplex paper supply unit 1000 and sorter 500.

The copy mechanism of copy machine 1 is substantially similar to that of conventional electrophotographic copy machines. A photosensitive drum 2 which is rotatably driven in a counterclockwise direction is centrally disposed in copy machine 1, the periphery of said photosensitive drum 2 having sequentially provided thereto a main eraser lamp 3, subcharger 4, suberaser lamp 5, main sensitizing charger 6, developing unit 7, transfer charger 8, transfer paper separating charger 9, and blade-type cleaning device 10. Photosensitive drum 2 is a drum having a photosensitive member (for example selenium) disposed on its surface and which, with each copy, undergoes light exposure by eraser lamps 3 and 5, is electrically charged by passing sensitizing chargers 4 and 6, and which then undergoes exposure to an image from the optical system that is explained hereinafter. Motor M 1 drives said photosensitive drum 2.

The optical system is disposed so as to permit scanning of an original document image from the underside of glass document platen 11. The optical system comprises a light source 12, first mirror 13, second mirror 14, third mirror 15, projecting lens 16, and fourth mirror 17. The original document image is transmitted to the photosensitive drum 2 via the individual mirrors 13, 14, 15 and 17 as indicated by line 18. Position switch SW500 is provided for detecting whether or not the specified position is maintained when the optical system is scanning. An auto exposure sensor 19 is affixed above the projecting lens 16 to measure the intensity of the reflected light from mirror 15 and detect the density of the original image. Magnification is set by moving projecting lens 16' in the light axial direction via motor M4. Motor M3 actuates the optical system. In the case of a copy magnification of "n," light source 12 and first mirror 13 are moved in a leftward direction at a speed (V/n) corresponding to the rotation of photosensitive drum 2 at a peripheral speed "V" (speed.is uniform at equal and variable magnifications), while simultaneously second mirror 14 and third mirror 15 move in a leftward direction at speeds of V/2n. In accordance with this movement, the image is projected from fourth mirror 17 through a slit portion to photosensitive drum 2.

On the left side of copy machine 1 is disposed an automatic paper supply cassette 20 at a top paper supply inlet, and a triplex paper supply unit 1000 at a bottom paper supply inlet, with a manual paper supply section 21 disposed in an upper section. The triplex paper supply unit 1000 is provided as an alternative option to the second auto paper cassette which is provided as standard equipment at the bottom paper supply inlet. Copy paper within auto paper supply cassette 20 and manual paper supply section 21 can be selectively supplied into copy machine 1 by, respectively, paper rollers 22 and 23, after which the paper transits either feed roller sets 24 or 25 and is fed to timing roller 26 which is at ready status and where said paper stops temporarily. Paper roller 30 is used for paper at the bottom paper supply inlet.

During transfers, copy paper that is supplied by timing roller 26 adheres to the photosensitive drum 2 located in the transfer area, and a toner image is transferred by means of a corona discharge from transfer charger 8. Then, said copy paper is separated from the top of photosensitive drum 2 by means of a corona discharge from separation charger 9 and the stiffness of the paper itself. Continuing, the copy paper is attracted onto feed belt 27 which is provided with an air suction means not shown in the drawing, and fed to the right (as shown in the drawing) via the clockwise rotation of belt 27. Next, the toner image undergoes a fixing process by passing through fixing unit 28. The copy paper then transits discharge set 29 and is discharged into sorter 500 outside the copy machine.

Paper size detector switches 401 to 404 and 405 to 408 are microswitches disposed in parallel array for the top and bottom paper supply inlets, respectively, which detect whether installation is in a lengthwise or widthwise direction with regard to the size and directional orientation of the copy paper within the cassettes. Copyable sizes (to wit, copy paper sizes which can be set in each supply section) are, for example, A3, A4, A5, B4 and B5 with sizes A4 and B5 being selectable in both lengthwise and widthwise directions. Switches 401 to 404 and 405 to 408 also detect removal of the cassettes, which means they indirectly detect the presence or absence of copy paper at the supply inlet. The copy paper size and set direction is detected in a 4-bit code corresponding to ON/OFF combination of switches 401 to 404 and 405 to 408, said codes being stored in RAM 213 of the CPU 1 control circuit (refer to FIG. 5). A single example of the code table for switches 401 to 404 is shown in a table hereinafter. This table indicates that the ON status of a switch is denoted by (0) and OFF status is denoted by (1); when all switches are OFF, cassette 20 is not inserted in the paper supply section, to wit, the absence of copy paper is detected.

Among the sensors attached to copy machine 1 is a manual feed table detection switch 410 that detects whether or not the manual feed table 21*a* is closed, said manual feed table 21*a* comprising manual feeder 21. Manual feed table 21*a* is closed when not in use. Sensors SEl and SE2 are the paper detection switches for the manual feeder 21

TABLE

| Binary Code | | | | | |
|---|---|---|---|---|---|
| SW1 | SW2 | SW3 | SW4 | Paper Size | Decimal Code |
| 0 | 0 | 0 | 0 | | 0 |
| 0 | 0 | 0 | 1 | | 1 |
| 0 | 0 | 1 | 0 | | 2 |
| 0 | 0 | 1 | 1 | A5 (length) | 3 |
| 0 | 1 | 0 | 0 | B5 (length) | 4 |
| 0 | 1 | 0 | 1 | A4 (length) | 5 |
| 0 | 1 | 1 | 0 | B4 (length) | 6 |
| 0 | 1 | 1 | 1 | A3 (length) | 7 |
| 1 | 0 | 0 | 0 | | 8 |
| 1 | 0 | 0 | 1 | | 9 |
| 1 | 0 | 1 | 0 | B5 (width) | 10 |
| 1 | 0 | 1 | 1 | A4 (width) | 11 |
| 1 | 1 | 0 | 0 | | 12 |
| 1 | 1 | 0 | 1 | | 13 |
| 1 | 1 | 1 | 0 | | 14 |
| 1 | 1 | 1 | 1 | Cassette Absent | 15 |

The triplex paper supply unit 1000 is movably supported on rail 1040 so that cassettes 1010, 1020 and 1030 can be set at the top, intermediate and bottom sections of the triplex paper supply inlets, respectively. Docking detector switch 1002 detects whether or not the triplex paper supply unit 1000 is attached to copy machine 1. Motor M5 drives the paper supply system of triplex supply unit 1000. Collectively, paper size detection switches 1011 to 1014, 1021 to 1024 and 1031 to 1034 detect the paper size at the top, intermediate and bottom paper inlets, respectively. Also, paper-type set switches 1015 and 1016, 1025 and 1026, 1035 and 1036 are switches for setting the paper types for the top, intermediate and bottom paper supply inlets, respectively. When a single cassette is selected which corresponds to any of the paper supply clutches 101; 1027 and 1037, said clutches connect feed rollers 1018, 1028 or 1038, whichever corresponds to the selected cassette, to the drive system and the specified sized paper is supplied to the copy machine 1.

Sensor 310 in ADF 300 detects whether or not the original document is fed, and sensor 311 detects whether or not a document is on document tray 304.

Motor 301 rotates the document feed belt 305 of the ADF and motor 302 supplies the document from document tray 304.

The inverter unit 330 is connected to ADF 300 and incorporates and operates switching hook 331 for inverting the document supplied from the ADF, said inverter unit 300 is driven by inverter motor 303. Passage of the document is detected by paper sensor 312.

Copy machine 1 has connected thereto a sorter 500 comprising a receiving section 520, bin assembly 530 having a plurality of bins, each of which is identified at reference numeral disposed vertically, feed section 540 having a vertically movable endless belt 541 disposed along said bin assembly 530, and a non-sort delivery section 550. Sorter 500 is driven by means of sorter motor 501. In addition, switching of both non-sort and sort paper paths is accomplished by a solenoid which alters the position of paper path switching hook 503.

In the sorting operation, a sheet discharged from discharge roller set 29 is received at the receiving section 520, and is delivered to one of the bins 531 from the delivery section 540 through feed section 550. Sorting is detected by paper sensor 512 provided at the inlet to delivery section 540. When complete delivery of all sheets is confirmed, the sorter bin change motor 502 is actuated and the delivery section 540 is moved opposite the inlet of the next bin 531, whereupon the fed paper is delivered to the next bin 531 in an identical manner. Thus, the sheets are distributed successively to bins 531, 531, etc., and when distribution is completed, delivery section 540 returns to its starting position opposite uppermost bin 531 at the uppermost level, and is on standby to distribute the copy sheets of subsequent documents.

During the non-sorting operation, sheets are fed to nonsort delivery section 550 from receiving section 520, and fed into tray 551. Paper sensor 551 detects the paper on the nonsorting path.

The copying operation of a copy machine of the aforesaid construction and the function of each of the various elements is well known to those skilled in the art, thus an explanation of these features is abbreviated.

(b) Operation Panel

Figure 2A:
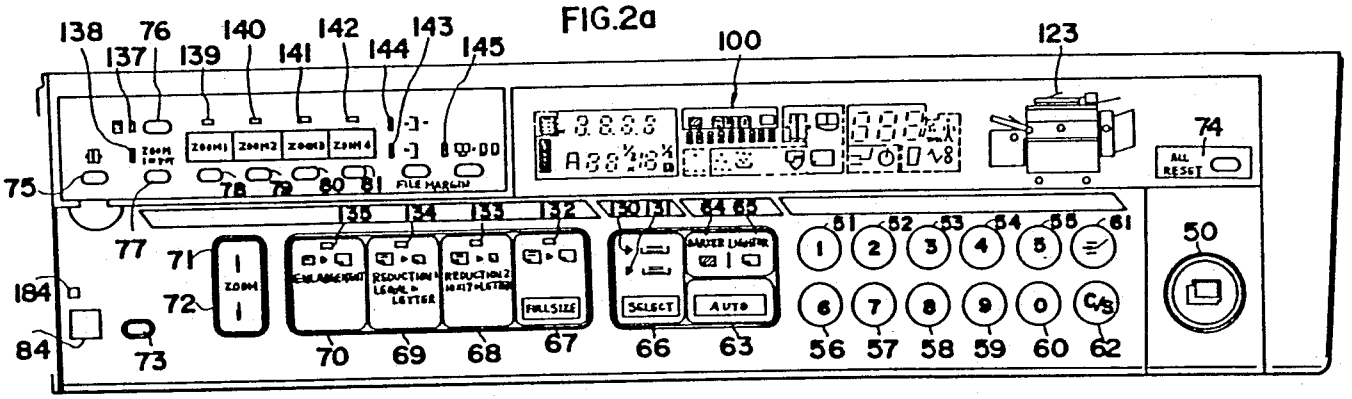
FIGS. 2*a* and 2*b* are a top view and front view, respectively, of the copy machine operation panel.
Figure 2B:
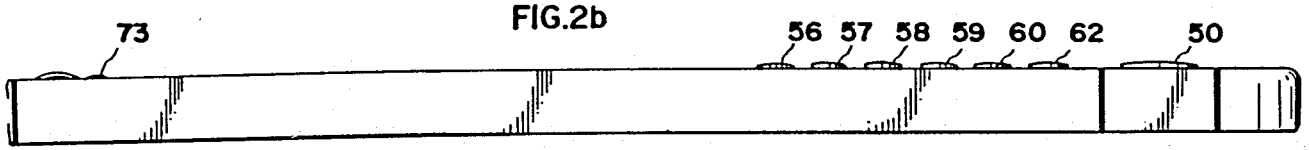

FIGS. 2*a* and 2*b* show an operation panel. The operation panel has keys provided thereto which are indicated by the following reference numbers:

Item 50 is a print button for starting the copy operation. Items 51 to 60 are the ten keys for entering the number of copies and the like. Item 61 is an interrupt key for interrupting the copy process. Item 62 is a clear/stop key (functions as a stop key to stop the multicopy process and a combination key for clearing the registry). Item 63 is a selection/cancel key for auto exposure. Item 64 is an exposure-reduction key used during manual exposure. Item 65 is an exposure-increase key used during manual exposure. Item 66 is an paper supply inlet selection key. Items 67 to 70 are copy magnification ratio selection keys for equal magnification, fixed two-step reduction and fixed one-step magnification. Item 71 is a magnification-increase key which increases the copy magnification incrementally in step units. Item 72 is a magnification-reduction key for reducing the magnification incrementally in step units. Item 73 is a counter display request key for sequentially calling up the parts maintenance (PM) counter display. Item 74 is a reset key for resetting the copy mode to the initial state. Item 77 is a zoom-magnification input key. I ems 78 to 81 are zoom-magnification selection keys for selecting a total of four selectively pre-set zoom magnifications. Item 84 is a duplex document. key.

Figure 3:
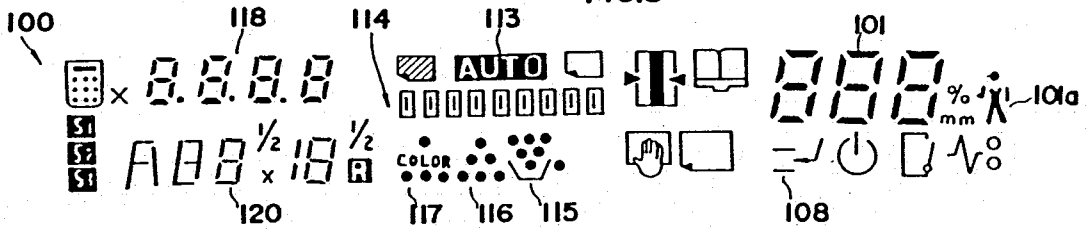
FIG. 3 is a top view showing the display of a fluorescent character display tube.

Display area 100 forms displays via a fluorescent character display tube as is clearly shown in FIG. 3, said display comprising items labeled by the following reference numbers.

Item 101 is a three-column display segment for displaying the copy number. Item 108 is an interrupt-copy display. Item 113 is an exposure-mode (auto or manual) display. Item 114 is an exposure-step display. Item 115 is a waste-toner full display. Item 116 is a toner-empty display. Item 117 is a color toner display. Item 118 is a copy magnification display. Item 120 is a paper size display.

The operation panel has disposed thereon display EDs, as shown in FIG. 2*a*, which are labeled by the reference numbers hereinafter described.

Item 123 is a monitor display. Item 130 is a top-paper-supply selection display LED. Item 131 is a bottom-paper-supply selection display LED. Items 132 to 135 are magnification key selection display LEDs. Item 138 is a zoom-input selection display LED. Items 139 to 142 are zoom-magnification key selection display LEDs. Item 184 is a duplex document key display LED.

Figure 4:
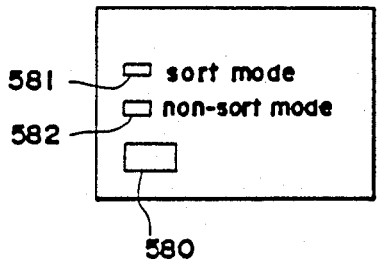
FIG. 4 is a top view of the sorter operation panel.

FIG. 4 shows the operation panel for sorter 500. Mode selection key 580 sets both the sort and non-sort modes, and sort mode LED 581 or non-sort mode display LED 582 are illuminated corresponding with the setting of said mode selection key 580.

(c) Configuration of the Copy Machine Control Area

Figure 5:
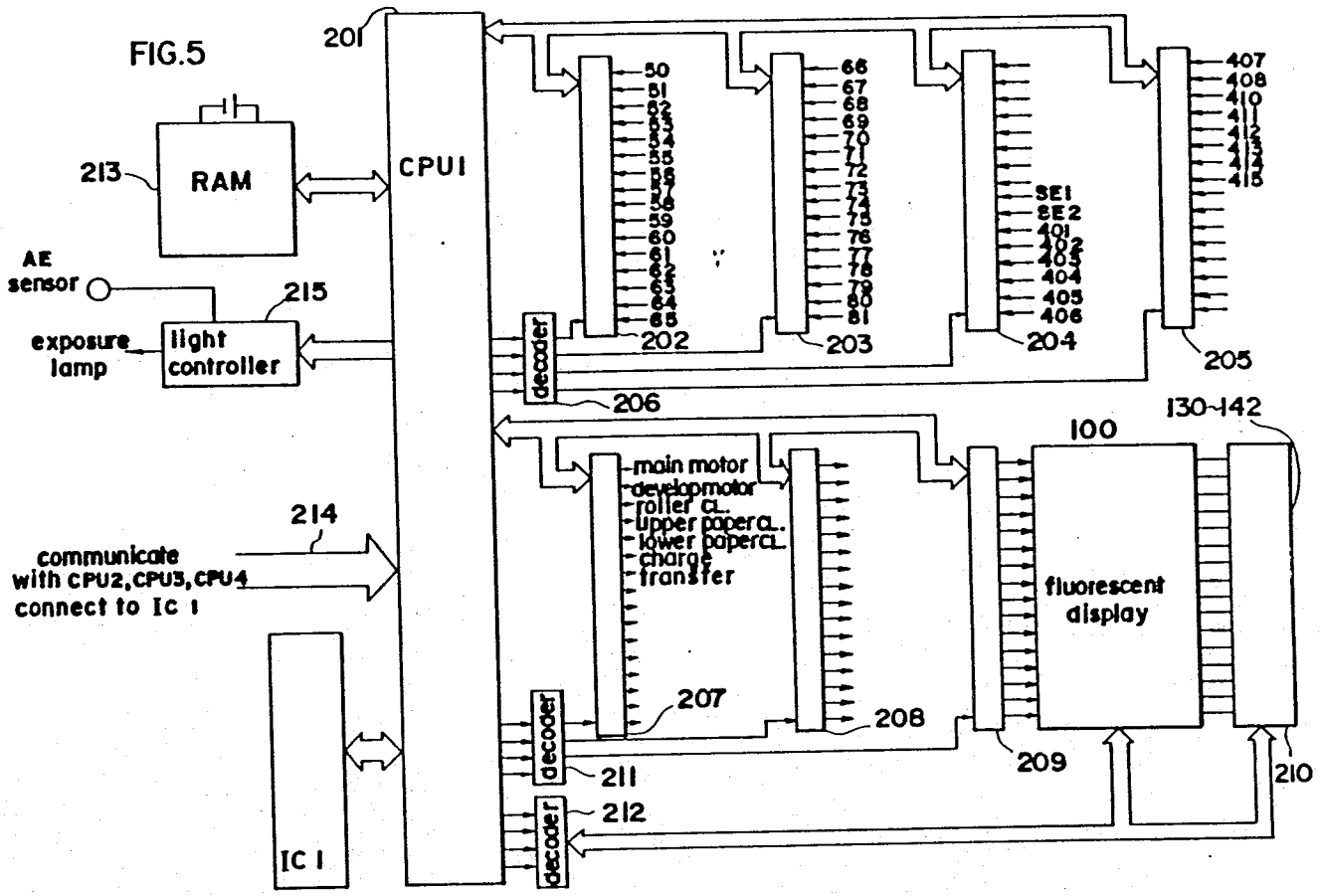
FIG. 5 is a circuit diagram showing the input/output to microprocessor CPU 1 which controls the copying machine.

FIG. 5 shows the input/output configuration of CPU 1 (201) which controls copy machine 1. Integrated circuits IC 202 to 205 and 207 to 209 are used for input-/output extension. IC 202 to 205 are input circuits and are connected by data line to CPU 1. Also, IC 202 to 205 are controlled by CPU 1 via decoder 206. Input terminals have connected thereto each type of key and display as shown in the drawing. IC 207 to 209 are output circuits whose control ports are connected to CPU 1 via decoder 211. In addition to the various components shown in the drawing, the output terminals also have connected thereto fluorescent character display tube 100 and LED matrix 210 (LEDs 120 to 125 and 130 to 145), which are respectively controlled by CPU 1 via decoder 212. Random access memory (RAM) 213 is connected to CPU 1 and backs up memory by means of a battery. Bus 214 is a communication line for connecting the other CPUs (CPU 2, CPU 3 and CPU 4). CPU 1 transmits as data the value selected from among the 9-step exposure values for manual exposure and the central auto exposure value for auto exposure in the dimmer circuit 215.

Figure 6:
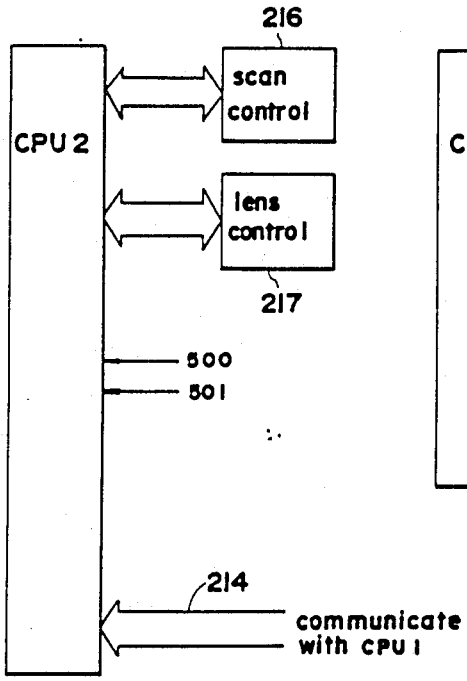
FIG. 6 is a circuit diagram showing the input to microprocessor CPU 2 which controls the optical system.

The input/output configuration for CPU 2 which controls the optical system is shown in FIG. 6. The CPU 2 input port connects to scanning motor control circuit 216 that controls scanning motor M3 and connects to variable magnification lens control circuit 217 which controls motor M4 that moves projecting lens 16. In addition, signals are input from the optical system position switch SW500 as well as from switch SW501 which generates the timing signals for the rotation of timing roller 26 during the equal magnification copy process.

Figure 7:
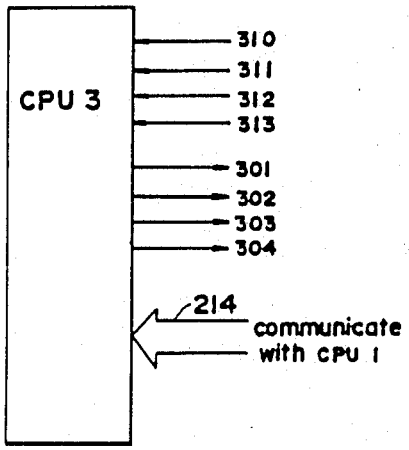
FIG. 7 is a circuit diagram showing the input to microprocessor CPU 3 which controls the auto document feeder (ADF).

FIG. 7 shows the input/output configuration of CPU 3 which controls the ADF 300. CPU 3 outputs signals to feed belt motor 301 and paper supply motor 302, and receives input signals from document sensor 310 and document detection sensor 311. CPU 3 also communicates with CPU 1 via bus 214.

Figure 8:
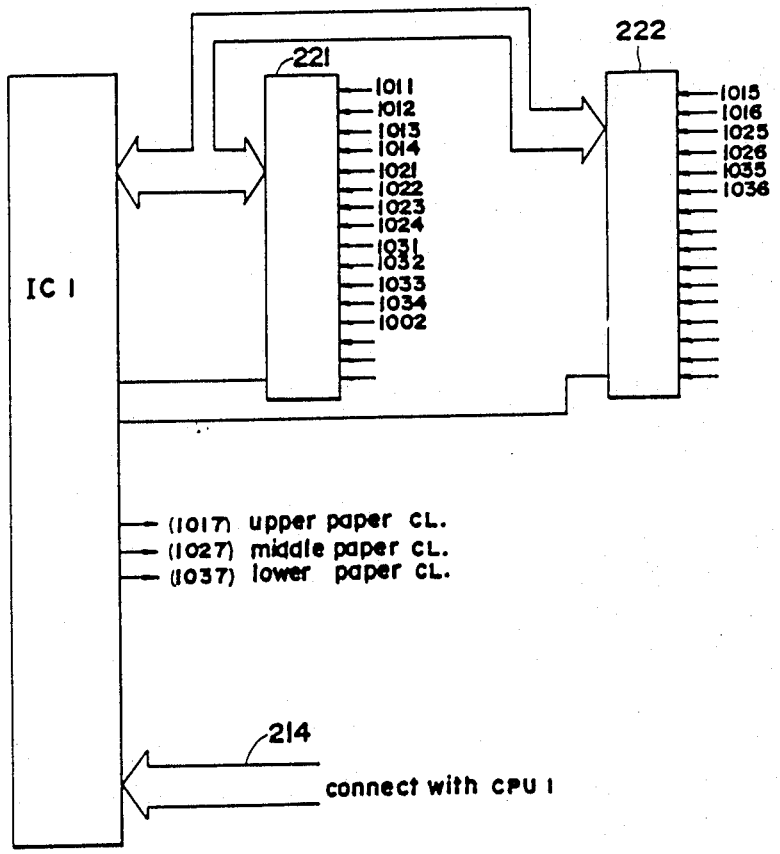
FIG. 8 is a circuit diagram showing the input to integrated circuit IC 1 which controls the triplex paper supply unit.

FIG. 8 shows the input/output configuration of IC 1 which controls triplex paper supply unit 1000. The IC 1 input/output ports have connected thereto top, intermediate and bottom paper supply clutches 1017, 1027 and 1037. IC 1 also connects to the various sensors shown in the drawing (a portion are labeled by reference numbers) via input expansion IC 221 and 222, in substantially the same manner as for CPU 1.

Figure 9:
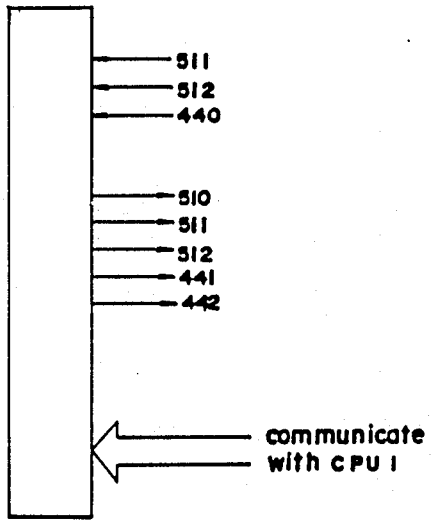
FIG. 9 is a circuit diagram showing the input to microprocessor CPU 4 which controls the sorter.

FIG. 9 shows the input/output configuration for CPU 4 which controls sorter 500. CPU 4 receives input signals from paper sensors 511 and 512 and from motor selection key 580 (refer to FIG. 4), while also sending output signals to each type of display (paper sensor display LEDs 510, 511 and 512, sort mode display LED 581 and non-sort mode LED 582).

(d) Part Maintenance (PM) Counters and Indicators

PM counters are provided for the various components (replacement parts) for which use frequency totals are determinable by the copy counter. In the present embodiment, PM counters are provided at the following nine locations.

| | Set Location | Sensor |
|---|---|---|
| Machine Body | (1) Top paper supply inlet (incl. manual copy) | Paper roller 22 (step S145) |
| | (2) Bottom paper supply inlet (incl. copy from triplex paper unit) | Paper roller 30 (step S148) |
| Triplex Unit | (3) Triplex top inlet | Roller 1018 (step S153) |
| | (4) Triplex intermediate inlet | Roller 1028 (step S156) |
| | (5) Triplex bottom inlet | Roller 1038 (step S158) |
| Sorter | (6) Non-sort paper path | Sensor 511 (step S553) |
| | (7) Sort paper path | Sensor 512 (step S534) |
| ADF (R) | (8) Document paper path | Sensor 310 (step S317) |
| | (9) Inverter unit paper path | Sensor 312 (steps S363 & S404) |

The various values are calculated via the actuation of the paper rollers disposed on the right side of the copy machine and via detection of the paper sensors.

Figures 10, 11:
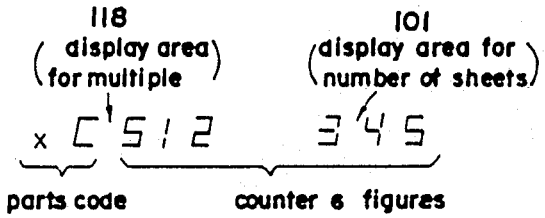
FIG. 10 is a table showing the part names and part codes which are counted by the part maintenance (PM) counters.
FIG. 11 is a diagram showing a single example of a PM counter display.

FIG. 10 shows the counter content corresponding to each PM counter number (1 to 9). All PM counters are software based (explained hereinafter in the CPU 1 program) counters, and the resulting values of said counters are stored in memory in RAM 213. On the right side in FIG. 10 are shown the part comes for the displayed contents of the PM counters.

Observation of the PM counter values (refer to the flow chart of FIG. 18) shows that when the counter display request key 73 is depressed, the parts code indicating the location of the PM counter and the numerical value (use frequency) are displayed using the magnification display 118 (four columns) and copy number display 101 (three columns). The example in FIG. 11, for instance, shows that the use frequency of the top roller (x ) of the triplex paper supply unit is 512345.

An actual display is shown in the sequence described hereinafter. Prior to depressing the counter display request key 73, the magnification and copy number are displayed in the magnification display 118 and copy number display 101, respectively. When the counter display request key 73 is depressed, the PM display mode is entered and the part code and contents for the initial PM counter (top paper supply inlet) are displayed (six columns). When PM counter display request key 73 is depressed once again, the part code and content of the next PM counter (bottom paper supply inlet) are displayed. Thereafter, subsequent PM counter part codes and contents are displayed with each depression of the counter display request key 73. When the part code and content of the final PM counter (ADF inverting unit) is displayed and said counter display request key 73 is again depressed, the display returns to its original status and the initial magnification and copy number are displayed.

The resetting of a PM counter value after part replacement is achieved via the following procedure. First, the counter display request key 73 is repeatedly depressed until it displays the part code and counter value for the replaced part, then the clear key (C/S key) 62 is depressed, thus bringing the total displayed value to, zero (0) (refer to the flow chart of FIG. 16). If the wrong part code is cleared, and the interrupt key 61 is depressed while the erroneous part code counter value is displayed, the value registered prior to the clearing procedure is restored (refer to the flow chart of FIG. 17) because the old value remains stored (FIG. 16, step S63) in the recall memory (PM SAVE counter) utilized for operational errors. Finally, the counter value is cleared by switching OFF the main switch SW. The recall memory for operational errors is also cleared (refer to the flow chart of FIG. 20).

(e) Copy Machine Operation

A brief explanation follows for the CPU 1 program which controls the copy machine 1.

Figure 12:
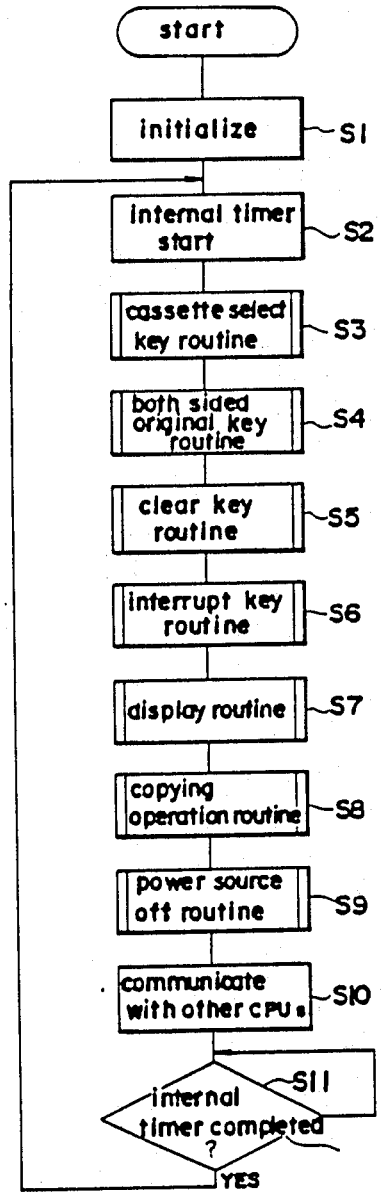
FIG. 12 is a flow chart of the main routine of the program which controls the copying machine.

A brief flow chart of the CPU 1 program is shown in FIG. 12. When CPU 1 is reset by starting the program, RAM is cleared and the CPU 1 program is initialized to initialize settings for all CPU 1 registers and set the initialization mode (step S1).

Next, an internal timer is started which is pre-set at the initialize values stored in CPU 1 (step S2). Then, each subroutine is sequentially processed (i.e., set selector process S3, duplex document key process S4, clear key process S5, interrupt key process S6, display process S7, copy operation process S8, and power OFF process S9). Thereupon, data communications begin among CPUs 2, 3 and 4 (step S10).

When all subroutine processing is completed, the completion of the initially set internal timer is awaited (step S11); one routine is completed and the program returns to step S2. The value of each timer appearing during the subroutine is determined using the time span of one routine. (Each timer value is determined by the repetitions until completion of said one routine.)

<e−2> Cassette Selector Key

Figure 13:
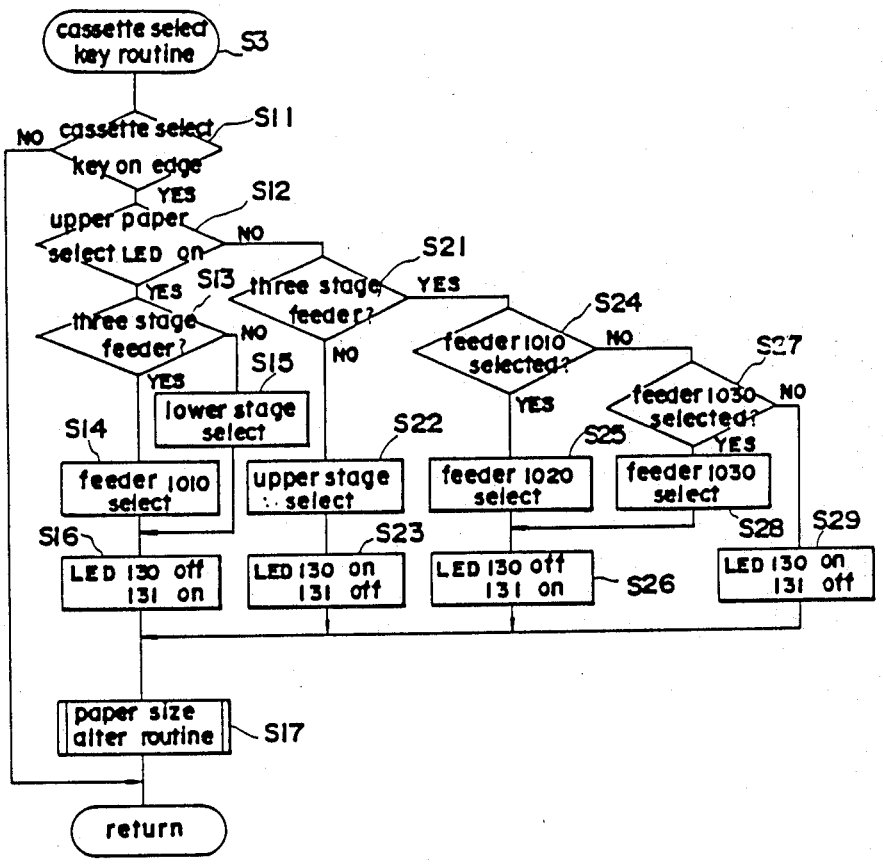
FIG. 13 is a flow chart showing the subroutine for cassette select key processing.

The cassette selector key (66) processing routine is described in FIG. 13. When cassette selector key 66 is depressed, the paper supply inlets are sequentially selectable.

When the cassette selector key 66 is at ON-edge status (step S11) and top paper supply display LED is ON, i.e., when the top paper supply inlet of copy machine 1 is selected (step S12), the top bin of triplex unit 1000 is selected (step S13) if said triplex unit 1000 is attached and the bottom paper supply inlet of copy machine 1 is selected (step S15) if said triplex unit 1000 is not attached. Display LED 131 is switched ON and display LED 130 is switched OFF (step S16). If the triplex paper unit 1000 is not attached when LED 130 is OFF (step S21), the main top paper supply inlet is selected (step S22), LED 130 is switched ON and LED 131 is switched OFF (step S23). When the triplex unit 1000 is attached and the top bin is registered (step S24), the intermediate bin is selected (step S25), and if the intermediate bin is registered (step S27), the bottom bin is selected (step S28) while LED 131 is in an OFF state (step S26). Furthermore, if the bottom bin selection is registered, the top bin of the copy machine 1 is selected and LED 130 is switched ON (step S29).

Subsequently, the paper size code change routine is called up (step S17).

Figure 14:
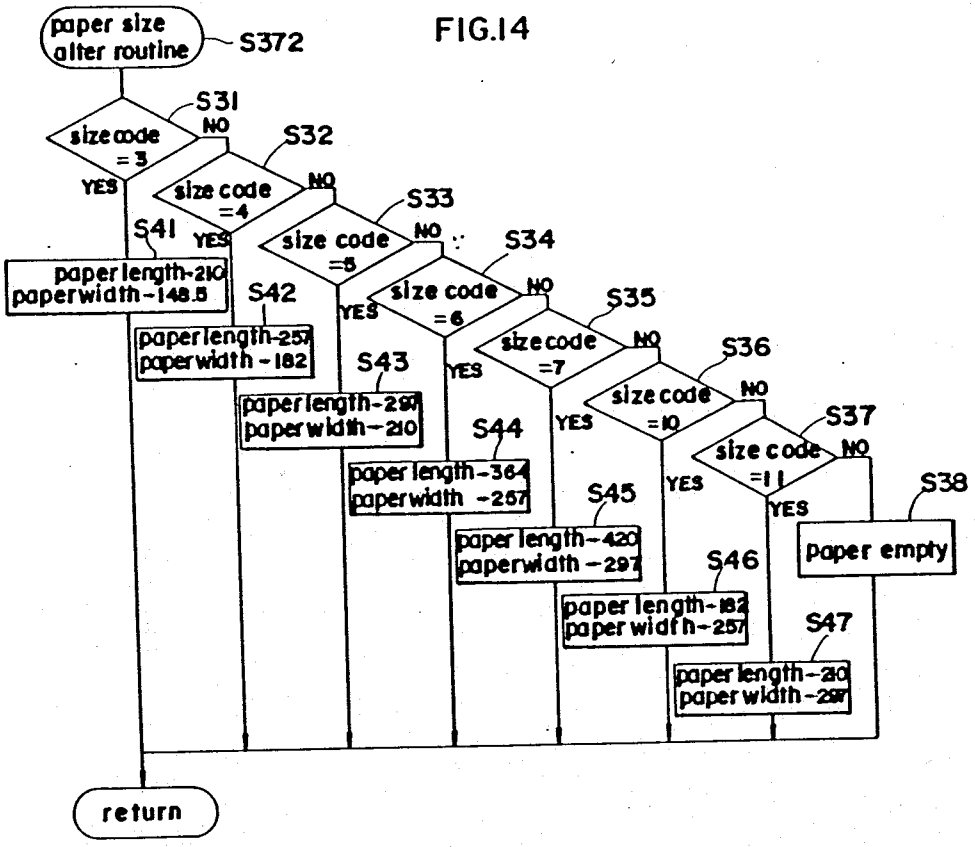
FIG. 14 is a flow chart showing the subroutine for a paper size modification.

A flow chart for the paper size code change routine is shown in FIG. 14. Paper size is encoded as shown in the previous table. If the input paper size code is "3" (step S31), paper length of 210 mm and paper width of 148.5 mm is stored in memory (step S41) because the code "3" means A4 size, lengthwise orientation.

Thereafter, if a paper size code of "4" (step S32) is input, B5/length data is stored; if a paper size code of "5" (step S33) is input, A4/length data is stored; if size code "6" (step S34) is input, B4/length data is determined; if size code "7" (step S35) is input, A3/length data is determined; if size code "10" (step S36) is input, B5/width data is determined; if size code "11" (step S37) is input, A4/width data is determined; the respective paper lengths and widths are stored in memory (steps S42 to S47). If none of the aforesaid codes are input, it is determined that there is no paper (step S38).

<e−3> Duplex Document Selection

Figure 15:
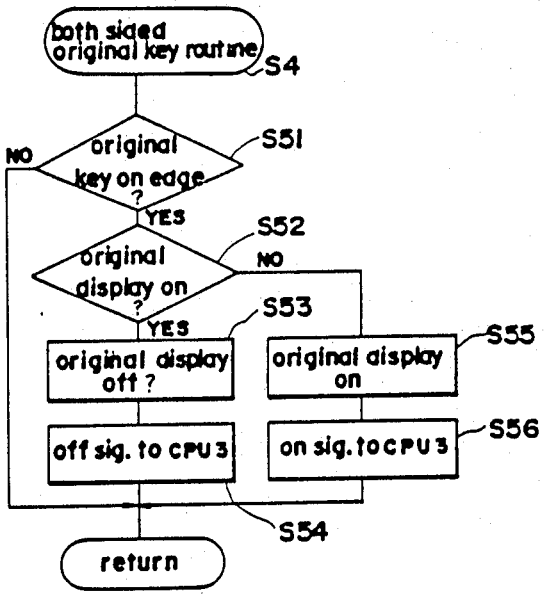
FIG. 15 is a flow chart showing the subroutine for duplex original key processing.

FIG. 15 shows the duplex document selection routine (step S4). When the duplex document key (selection key) 84 is at ON-edge status (step S51) and the selection display 84*a* is ON (step S52), said selection display 84*a* is switched OFF (step S53) and the duplex document signal to the CPU 3 is also switched OFF S54). When display 84*a* is OFF (step S52), and subsequently switched ON (step S55), the duplex document signal to the CPU 3 is also switched ON (step S56).

<e−4> Clearing Process

Figure 16:
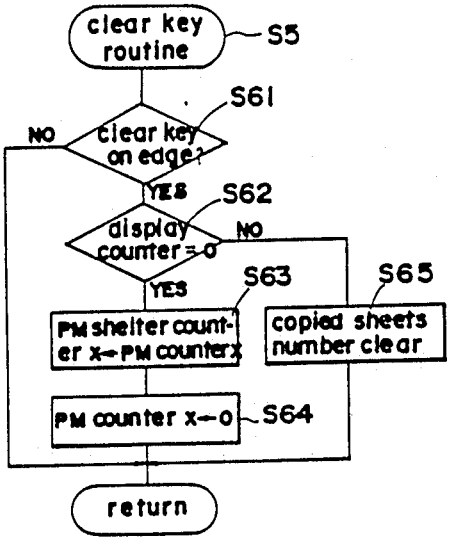
FIG. 16 is a flow chart showing the subroutine for clear key processing.

FIG. 16 shows clear key processing routine (step S5). When clear key 62 is at ON-edge status (step S61) and the display counter registers "0," the conventional copy number clear function is obtained (step S65). If the display counter registers a value other than "0," (i.e. when any PM counter value is displayed) (step S62), however the counter value is stored in the memory of the SAVE counter (step S63 and the counter itself is cleared to a zero (0) value (step S64).

<e−5> Interrupt Key Processing

Figure 17:
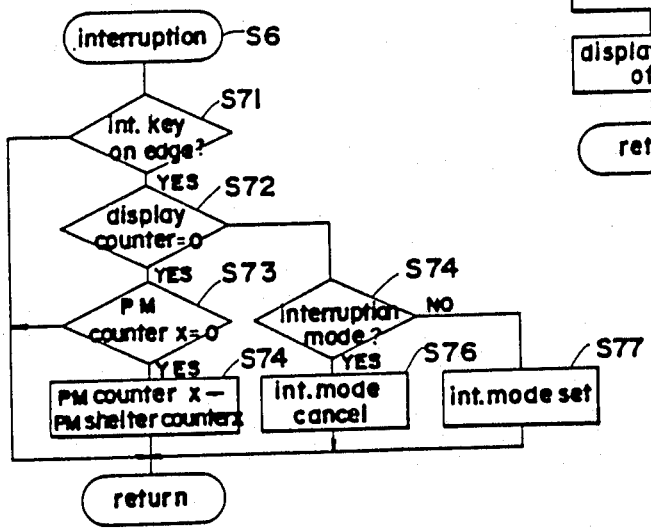
FIG. 17 is a flow chart showing the subroutine for interrupt key processing.

FIG. 17 shows the interrupt key processing routine (step S6). When the interrupt key 61 is at ON-edge status (step S71) and the display counter registers "0" (step S72), the key 61 functions as a conventional interrupt key (i.e., in the interrupt mode (step S75) it is cancelled) (step S76) and if not in the interrupt mode, the mode is initiated (step S77). When the display counter registers a value other than "0," to wit, if any PM counter value is displayed and the displayed value is "0" (step S73), the value stared in the SAVE counter (step S63) in the FIG. 16 flow chart is returned to the normal counter (step S74) and a clear key misoperation follows.

<e−6> Display Processing

Figure 18:
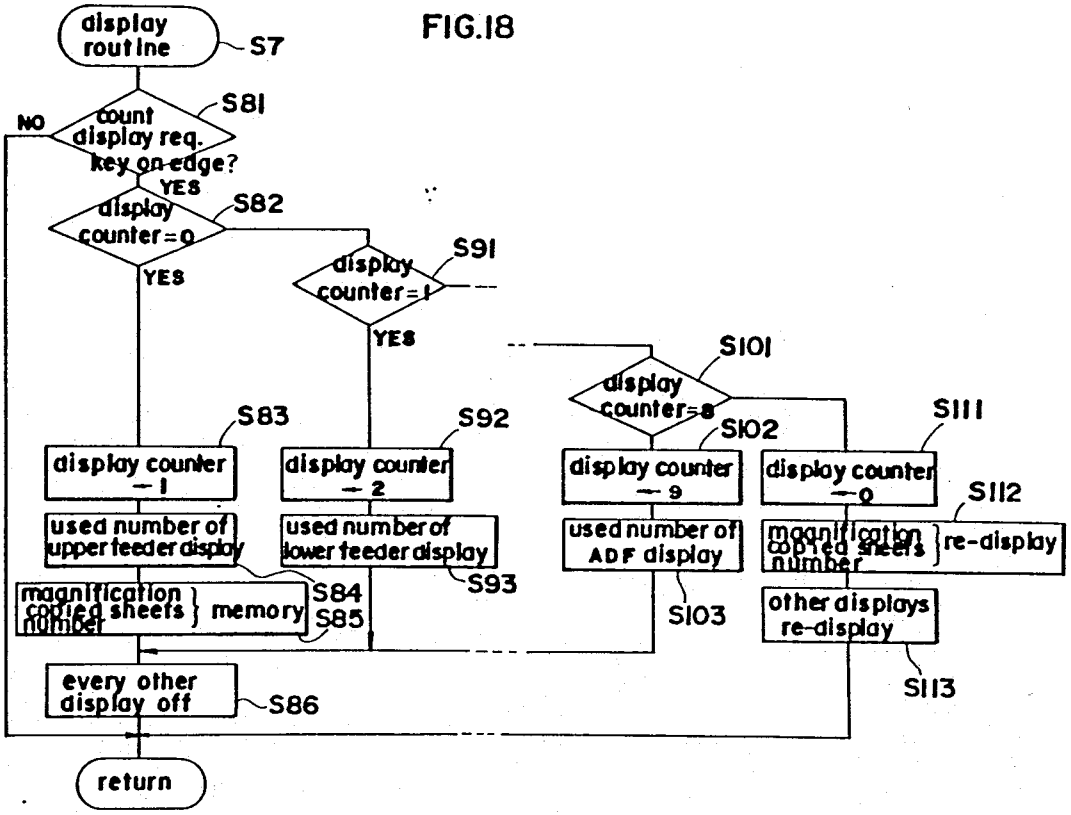
FIG. 18 is a flow chart showing the subroutine for indicator processing.

FIG. 18 shows the display processing routine (step S7). When the counter display request key is at ON-edge status (step S81) and the display counter registers "0" (step S82) (i.e. when the original magnification and copy number are displayed) a value of "1" is re-registered on the display counter (step S83) and the top paper supply inlet use frequency is displayed (step S84) as shown in FIG. 11, for example, xA123 456. The magnification and copy number data is eliminated after storage in memory (step S85) while simultaneously all other displays are switched OFF (step S86).

Thereafter, when the display counter values are 1, 2, 8 (steps S91 and S101), the display counter values are respectively incremented by a value of one (1) (steps S92 and S102), and the bottom paper inlet use frequency, triplex top paper inlet use frequency, triplex intermediate paper inlet use frequency, triplex bottom inlet use frequency, sort/nonsort path use frequency, sort/sort path use frequency, ADF document roller use frequency, and ADF inverting unit use frequency are sequentially displayed (steps S93 and S103). (The data in the drawing is abbreviated to display files 2 to 7.) Then, all other displays are switched OFF (step S86).

If the counter display request key s depressed while the ADF inverting unit use frequency is displayed (step S101), the display counter registers a value of "0" (step S111) and simultaneously the magnification and copy numbers stored in memory are recalled (step S112), then the other displays are also returned to their initial states (step S113).

<e−7> Copy Operation

A flow chart showing the copy operation routine S8 is shown in FIG. 19. When the print button 50 is at ON-edge status (step S131) and the ADF is not used (step S132), the copy initialization flag is set at "1" (step S133). If the ADF is used (step S132) and a document is in document tray 304 (step S134), the ADF-start signal for ADF 300 is set at "1" (step S135). If no document is in document tray 304 (step S134), the routine continues.

If the print button 50 is not at ON-edge status (step S131) and the ADF is used (step S136), a document position signal of "1" is received from ADF 300 (step S137) and the copy initialization flag is set at "1" (step S138).

Then, the copy operation is performed. The main motor M1 and the developer motor are switched ON in step S141 when the copy initialization flag is set at "1," the sensitizing charger, transfer charger and the like are switched ON and the copy initialization flag is set at "0," and timer-A (T-A) and timer-B (T-B) are set (step S142). Subsequently, the paper roller for the selected paper supply inlet is actuated (i.e. when the main top bin paper inlet is selected) (step S143), the top bin paper roller 22 is actuated (step S144) and the PM counter 1 is incremented (step S145). When the main bottom paper inlet is selected (step S146), the bottom bin roller 30 is actuated (step S147) and the PM counter 2 is incremented (step S148). Because the bottom paper inlet is also used when the triplex paper unit 1000 option is used, bottom paper roller 30 is actuated (step S149) and the PM counter 2 is incremented (step S150). When the top bin of the triplex unit is selected (step S151), the triplex top paper roller 1018 is actuated (step S152) and the PM counter 3 is incremented (step S153). When the intermediate bin of the triplex unit is selected (step S154), triplex intermediate paper roller 1028 is actuated (step S155) and the PM counter 4 is incremented (step S156). According to the aforesaid description, the triplex bottom paper roller 1038 is actuated (step S157) by the selection of the bottom bin of the triplex unit, and the PM counter 5 is incremented (step S158).

In step S161, timer T-A is judged and at the completion of said timing the scanning signal is switched ON (step S172).

In step S181, the timing signal is set at "1" and a timing roller clutch (not shown in the drawing) is switched ON, and timer T-C is set (step S182).

When timer T-C reaches completion in step S191, the charging, scanning signal and timing roller clutch are switched OFF (step S192).

When the optical system return signal is "1" in step S201 (i.e. when the return initializes), then a determination is made as to whether or not a multi-copy process is completed (step S202) and if not, the copy initialization flag is set at "1" (step S203). The scanner, which has moved from its once-set position, returns and position sensor SW500 is switched ON (step S204), then, the developer motor and transfer are stopped and timer T-D is set (step S205). The main motor M1 is stopped (step S212) during the timing by timer T-D (step S211). The results of the processing up to this point are then output (step S215).

<e−8> Power OFF

Figure 20:
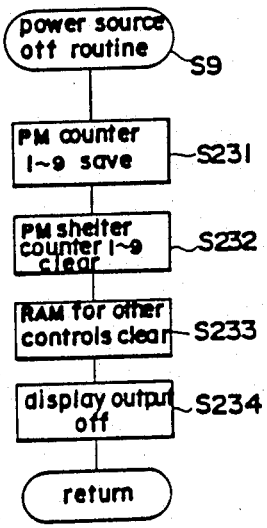
FIG. 20 is a flow chart showing the power-OFF subroutine.

FIG. 20 shows the power OFF routine (step S9). Data from PM counters 1 to 9 are saved (battery backup) (step S231), and PM SAVE counters 1 to 9 are cleared (step S232). Also, additional control RAM 213 cleared (step S233) and displays and drive output are switched OFF (step S234).

(f) ADF Operation

Figure 21A:
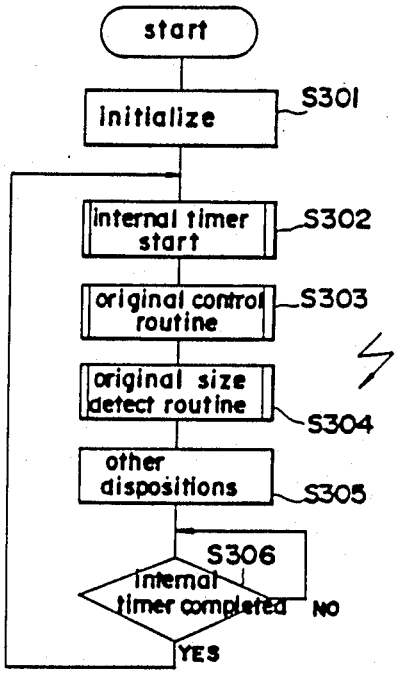
FIGS. 21*a* and 21*b* are flow charts showing the main program routine for the microprocessor CPU 3 which controls the auto document feeder (ADF).
Figure 21B:
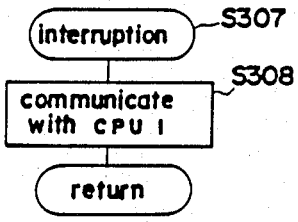

FIGS. 21*a* and 21*b* show flow charts summarizing CPU 3 which controls ADF 300. When CPU 1 is reset by initializing the program, RAM 213 is cleared and the CPU 1, program is begun to initialize settings for all CPU 1 registers set the initialization mode (step S301).

Next, an internal timer is started which is pre-set at the initialize values stored in CPU 1 (step S302).

Then, each subroutine is sequentially processed (i.e., document size detection (step S304) of document ) (step S303), and subroutines of other processes are completed (step S305). When all subroutine processing is completed, the completion of the initially set internal timer is awaited (step S11) and routine 1 is completed (step S306). The count for each timer is determined during the subroutine using the time span of one routine. (Each timer value is determined by the repetitions until completion of said one routine.)

Additionally, as shown in FIG. 21*b*, data communications with CPU 1 (step S308) are unrelated to the main routine initiated by interrupt request (step S307) from CPU 1 and are conducted by means of the interrupt routine.

The document control routine (step S303) is shown in FIG. 22. When a document is in the document tray (document detection sensor 311 is ON) (step S311) and the ADF start signal output from CPU 1 is "1" (step S312) or the document flag is set at "1" (step S313), said document flag is reset at "0" and the program continues to step S315. When the surface flag is "0" (step S315), it is subsequently reset at "1" (step S316), PM counter 8 is incremented (step S317), feed belt motor 301 begins normal rotation, and the document feed motor 302 is actuated (step S318). If steps S311, S313 and S315 are negative, the program immediately continues to step S321.

Subsequently, the document-feed routine (step S322) or the document inverting routine (step S323) is processed depending on whether or not the duplex document signal is "0" (step S321). Next, the sheet number area scanning is completed (step S324) and the scan-completed flag is set at "1" (step S325).

When the scan-completed flag is set at "1" (step S331) and the duplex document signal is "0" (step S332) or the surface flag is not set at "1" (step S333), the surface flag and scan-completed flag are set at "0" (step S334) and the document discharge routine is processed (step S335). When the surface flag is set at "1" (step S333) the document inverting routine is processed (step S336).

Figure 23:
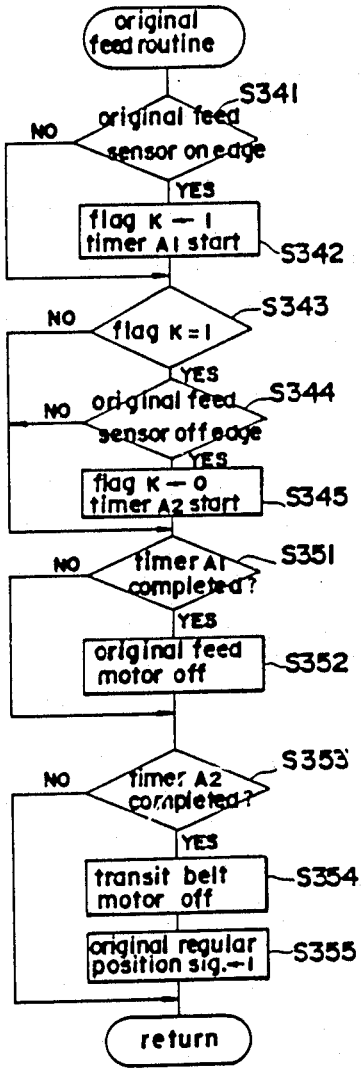
FIG. 23 is a flow chart showing the subroutine for the original document feeding process.

A document-feed routine S322 is shown in FIG. 23. When the document is fed and document sensor 310 is ON (step S341), flag K is set at "1" and timer A1 is started (step S342). The timer A1 is used to stop the document feed motor 302 to prevent the feeding of a subsequent document before a prior document is finished being fed, said timer is actuated by document feed belt 305 and the timer value is set to match the arrival of a specified portion of the belt.

Next, when the document sensor 310 arrives at OFF-edge status while flag K is set at "1" (step S343), to wit, when the end of the document is detected (step S344), flag K is set to "0" and timer A2 is started (step S345). The value of timer A2 is set until the end of the document arrives at the front edge position of the document platen.

Document-feed motor 302 is stopped (step S352) by the completion of timer A1 (step S351). Feed-belt motor 301 is stopped (step S354) by the completion of timer A2 (step S353) and a document position signal is sent to CPU 1 (step S355).

Figure 24:
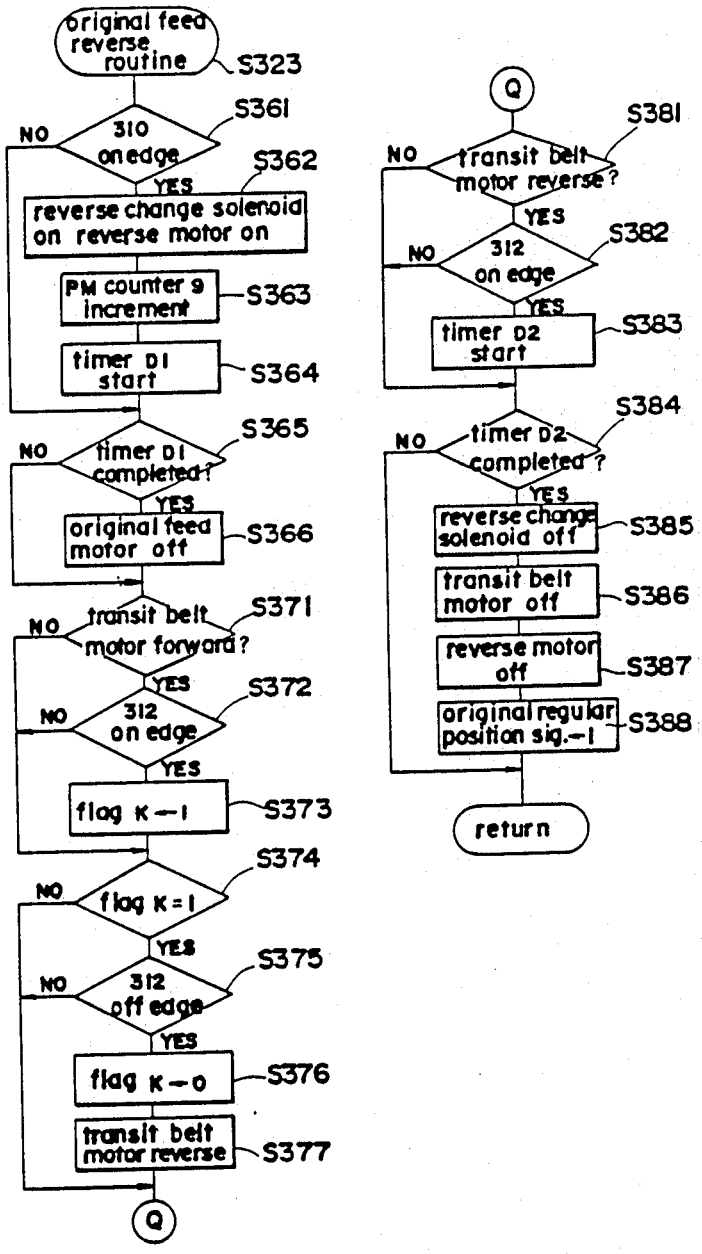
FIG. 24 is a flow chart showing the subroutine for the original paper supply inverting process.

FIG. 24 shows the document inverting routine (step S323). When the document sensor 310 is at ON-edge status (step S361) (i.e. when a subsequent document is fed) the inverting switch solenoid and inverting motor are switched ON (step S362) and PM counter 9 is also incremented (step S363). Then, timer D1 is started (step S364). Timer D1 sets the time during which said fed document is fed via the actuation of the feed belt.

Next, a determination is made as to whether or not timer D1 has been completed (step S365), and if it has, the document-feed motor is stopped (step S366).

While the feed belt is rotating in the normal direction (step S371) and paper sensor 312 is at ON-edge status (step S372) (i.e. when the front edge of the document reaches the inverting unit side), flag K is set at "1" (step S373). While flag K is set at "1" (step S374) with the paper sensor 312 at OFF-edge status (step S375) (i.e. when the document is completely inserted into the inverting unit), flag K is set at "0" (step S376) and the feed belt motor begins reverse rotation (step S377). While said feed belt motor rotates in a reverse direction (step S381) with the paper sensor 312 at ON-edge status (step S382) (i.e. when the document is inverted and discharged from the inverting unit), timer D2 is started (step S383). Timer D2 sets the time during which the document arrives at the document edge position on the document platen. When timer D2 is complete (step S384), the inverting switch solenoid, feed belt motor and inverter motor are switched OFF (steps S385 and S386), then a document position signal of "1" is sent to CPU 1 (step S388).

Figure 25:
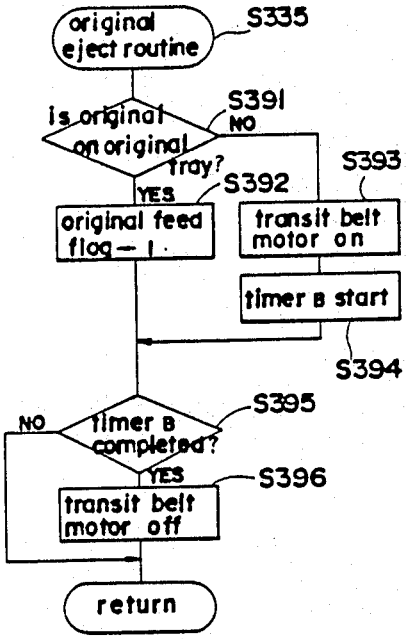
FIG. 25 is a flow chart showing the subroutine for the original document discharge process.

A document discharge routine S335 is shown in FIG. 25. When it is determined that another document remains in the document tray by means of document sensor 311 (step S391), the document flag is set at "1" (step S392). When the document tray is empty, the feed belt motor 305 rotates in the normal direction (step S393) and timer B is started (step S394). Timer B is set for a time period wherein a document (longest size) on the document platen can be discharged. Feed belt 301 is stopped (step S396) by the completion of timer B (step S395).

Figure 26:
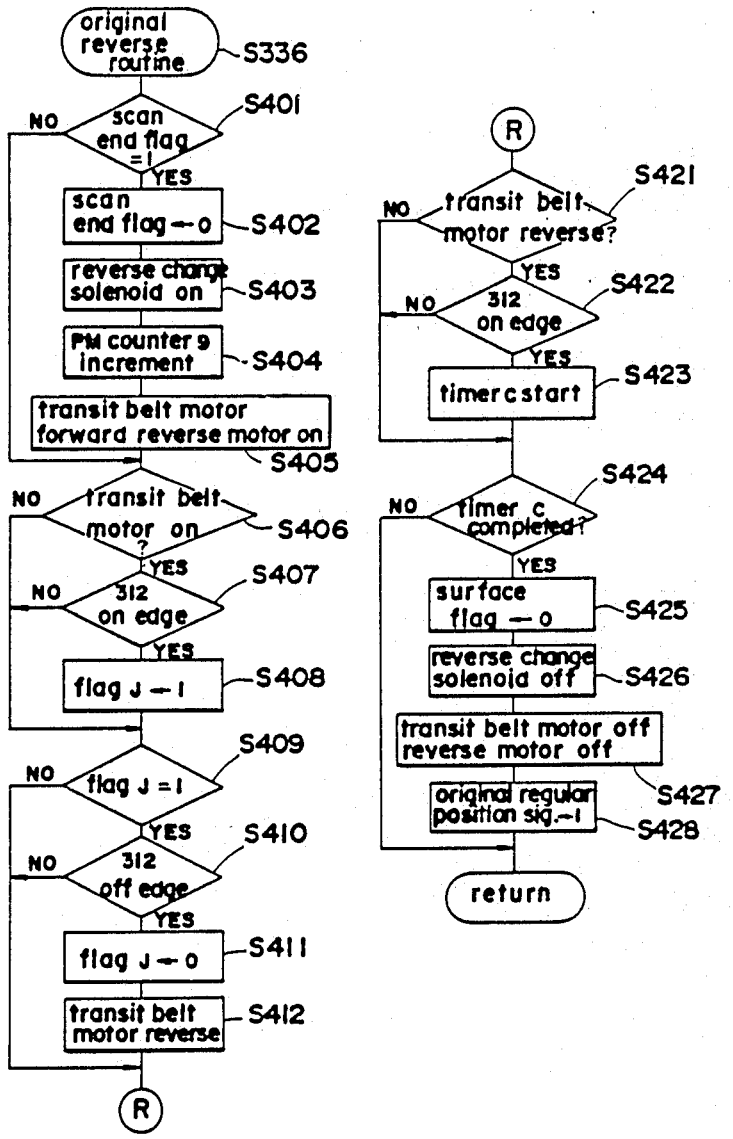
FIG. 26 is a flow chart showing the subroutine for the original document inverting process.

FIG. 26 shows the document inverting routine (step S336). If the scan-completion flag is set at "1" (step S401), it is reset at "0" (step S402), the inverting switch clutch is switched ON (i.e., the bifurcated hook is switched to the inverting unit side) (step S403), PM counter 9 is incremented (step S404), the feed belt motor begins rotation, in the normal direction, and the inverter motor is switched 0N (step S405).

While the feed belt motor rotates in a normal direction (step S406), paper sensor 312 is at ON-edge status (step S407) (i.e. until the front edge of the document reaches the inverting unit side) and flag J is set at "1" (step S408). Then, while flag J is set at "1" (step S409) with the paper sensor 312 at OFF-edge status (step S410) (i.e. until the entire document is inserted into the inverting unit), flag J is reset to "0" (step S411) and the feed belt motor begins reverse rotation (step S412).

During the reverse rotation of said feed belt motor (step S421), the paper sensor is at ON-edge status (step S422) (i.e. until the document is inverted and discharged from the inverting unit) and timer C is started (step S423). Timer C sets the time period wherein the document reaches the front edge position of the document platen. When timer C signals completion (step S424), the surface flag is set at "0" (step S425), inverting switch clutch is switched OFF (step S426), and feed belt motor and inverter motor are stopped (step S427), then a document position signal of "1" is sent to the CPU 1 (step S428).

(g) Sorter Operation

Figure 27A:
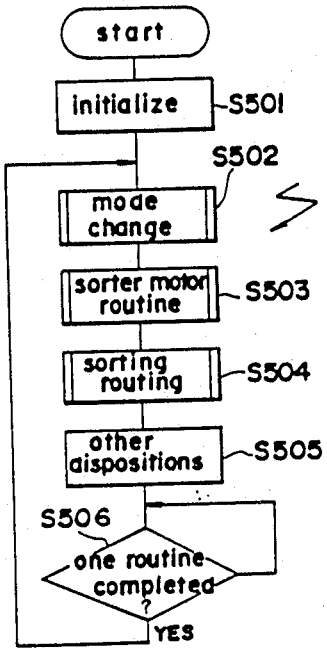
FIGS. 27*a* and 27*b* are flow charts showing the main program routine for the microprocessor CPU 4 which controls the sorter.
Figure 27B:
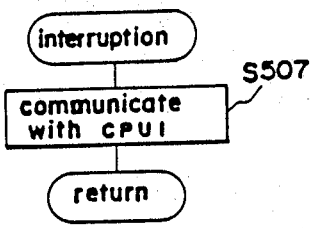

FIGS. 27*a* and 27*b* show brief flow charts of the CPU 4 program which controls sorter 500. When the program starts, initialization is performed (step S501). Then, the various subroutines are processed, e.g., mode switching process (step S502), sorter motor process (step S503), sorting process (step S504), and other processes (step S505). When processing of all subroutines is completed, the completion of the pre-set internal timer is awaited (step S506), one routine is completed and the program returns to step S502.

When an interrupt from CPU 1 is input, the communication with CPU 1 is performed (step S507).

Figure 28:
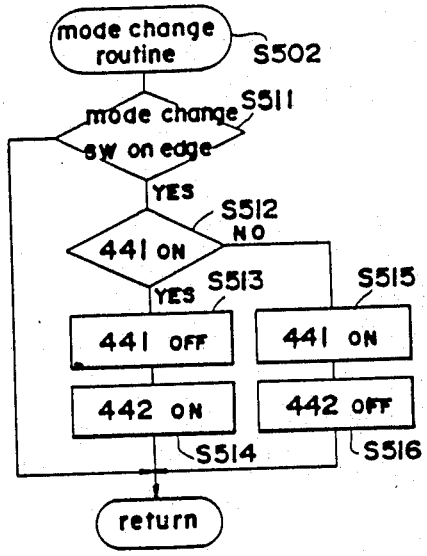
FIG. 28 is a flow chart showing the subroutine for the mode switching process.

FIG. 28 shows the mode switching routine. When the mode switch SW is switched ON it is at ON-edge status (step S511); if the sort mode selection is registered at that time (step S512), it is then switched to the non-sort mode (steps S513 and S514), and similarly if the non-sort mode is registered at that time (step S512), it is then to the sort mode (steps S515 and S516).

Figure 29:
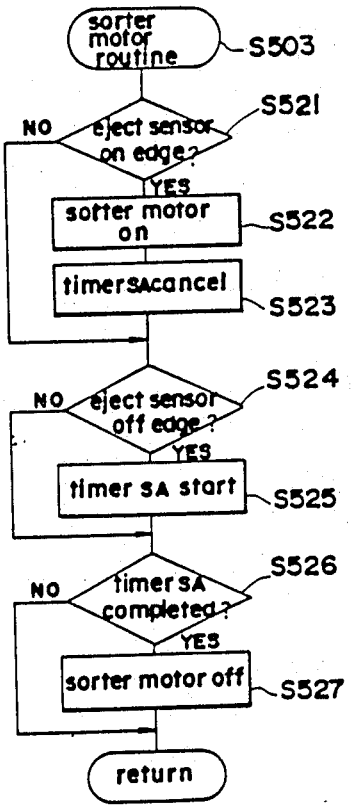
FIG. 29 is a flow chart showing the subroutine for sorter motor processing.

FIG. 29 shows the sorter motor routine. When the main discharge sensor is at ON-edge, status (step S521) (i.e. when the signal arrives that front edge of the paper has switched the discharge sensor ON), the sorter motor is switched ON (step S522). Simultaneously, the timer SA which stops the sorter motor is cancelled (step S523).

Then, timer SA is started (step S525) when the main discharge sensor is at OFF-edge status (step S524), i.e. when a signal arrives that the back edge of the paper is withdrawn.

Also, when timer SA is completed (step S526) the sorted motor is switched OFF (step S527).

Figure 30:
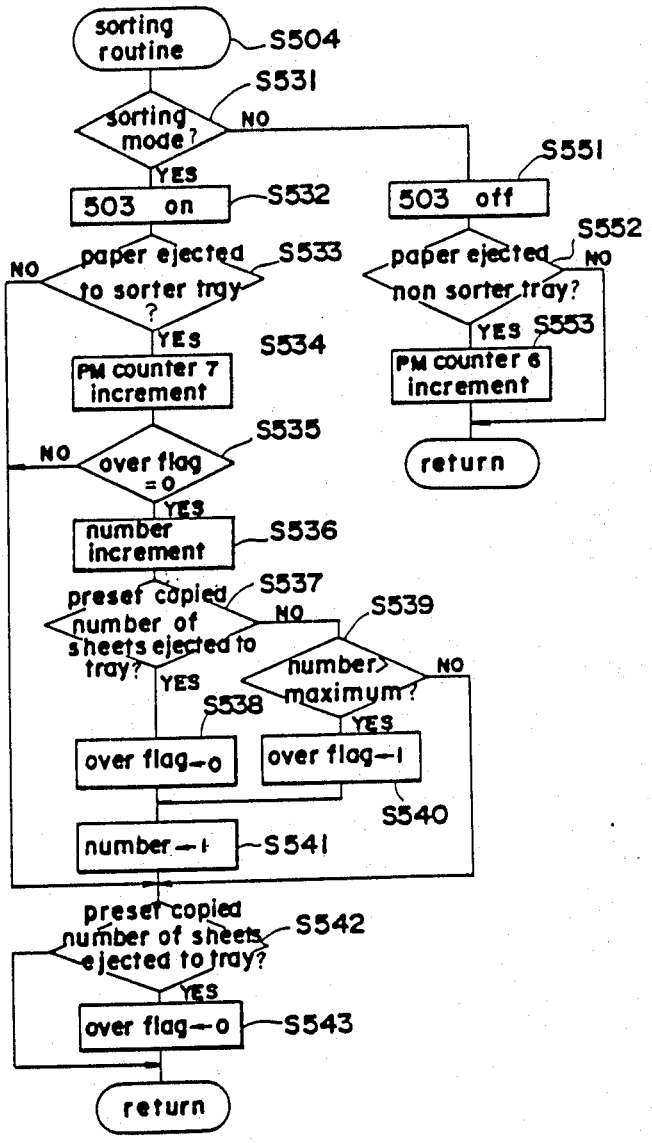
FIG. 30 is a flow chart showing the subroutine for the sorting process.

FIG. 30 shows the sorting routine (step S504). First, a determination is made as to whether or not the sorting mode is selected (step S531). If the sorting mode is selected, the paper path switching hook 503 is actuated (step S532) and the paper supply path is switched to to the sorting path.

Subsequently, when the paper is discharged to the sorter tray (step S533), the PM counter 7 is incremented (step S534). If the OVER flag is set at "0" (step S535), the sorter bin number is incremented (step S536) and the paper discharge head is moved to the next bin. Then, when the set number of copies are completed they are discharged to the sorter tray (step S537) and the OVER flag is set at "0" (step S538). The OVER flag is set at "1" (step S540), however, when the set number of copies is greater than the capacity of the sorter bin (step S539) or the sorter bin No. exceeds the largest bin. In either case, the bin No. returns to the No. 1 top bin (uppermost bin) (step S539).

Thereafter, when the set number of copies is discharged to the sorter tray (step S542), the OVER flag is reset at "0" (step S543).

If the sorting mode is not selected (step S531), the paper path switching hook 503 is not actuated (step S551), the paper supply system path is switched to the non-sort path, and when the paper is discharged into the non-sort tray 551 (step S553) the PM counter 6 is incremented (step S554).

An explanation of another embodiment related to the present invention follows hereinafter.

As discussed, copy machine (part replacement, lubricants, cleaning, and the like) periods differ depending on the production lot distribution for the various machines and user service conditions. For example, maintenance conditions differ for a user who has a light volume of copying over a long-term period and a user who has heavy volume over the short term, even though their total numbers of copies may be identical.

The present embodiment provides a copy machine for which the different maintenance periods for every copy machine can be readily determined.

The present embodiment provides a copy machine having a simple maintenance counter which calculates the number of copies until subsequent maintenance servicing in accordance with the peculiarities of each copy machine.

That is to say, the present embodiment comprises a maintenance call display for displaying a maintenance call when a counter value reaches a specified value because said maintenance counter value increments with each copy operation, an initial value input means for setting the aforesaid initial counter value in the counter, an initial counter value memory means, and a display means for recalling data from said memory means.

Copy machine operations which calculate the maintenance counter value may do so as each single sheet of copy paper is copied, or may do so as every ten sheets of copy paper are copied. Furthermore, the copy operation can freely determine whether or not a mis-copy has occurred.

The following explanation relates to the case wherein a single maintenance counter is provided for copy machine. In such a case, a maintenance counter readout is requested via the counter display request key 73 shown in FIG. 2, and said counter is displayed using the copy magnification section 118 and copy number display section 101 shown in FIG. 11.

In addition, the, service-call mark 101*a* is a maintenance call display, with the need for maintenance being reported by displaying (lighting) said mark.

In the present embodiment, a maintenance counter comprises a subtractor-type counter capable of negative calculation of values less than zero (0); the maintenance call display is switched ON when the counter value falls below zero (0).

Figure 31:
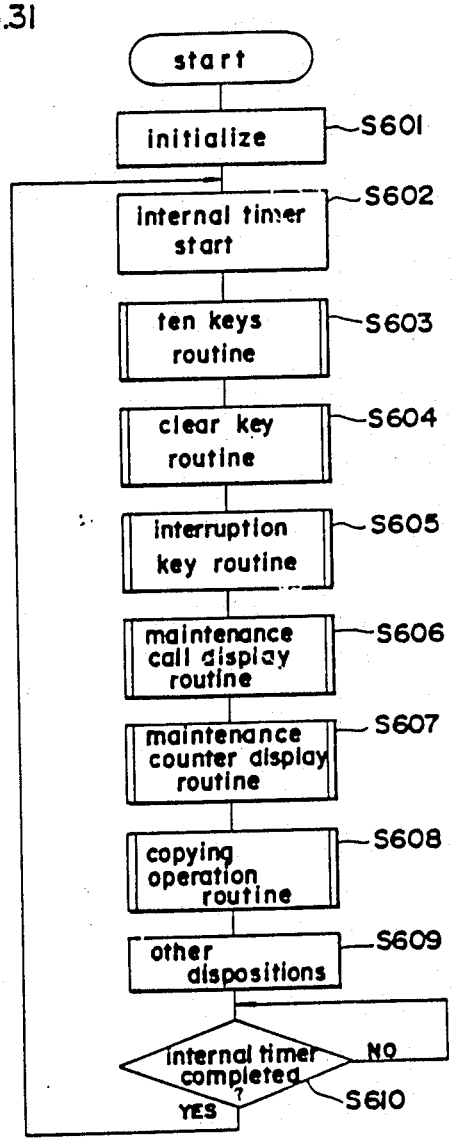
FIG. 31 is a flow chart showing the main routine for another embodiment of a copy machine related to the present invention.

FIG. 31 is a flow chart swing the main routine. When the process is started by inputting power, the initialization state is set (step S601) as illustrated in FIG. 31.

An internal timer is started (step S602) which sets the time period for the main routine. Each subsequent routine is processed in the order described hereinafter: Ten-key 51 to 60 routine (step S603), clear key 62 routine (step S604), interrupt key 61 routine (step S605), maintenance call display routine (step S606), maintenance counter display routine (step S607), and copy operation routine (step S608). Thereafter, other processing is performed, such as communications with other CPUs and the like, the completion of the internal timer is awaited (step S610), the program returns to step S602 and the loop is repeated.

Figure 32:
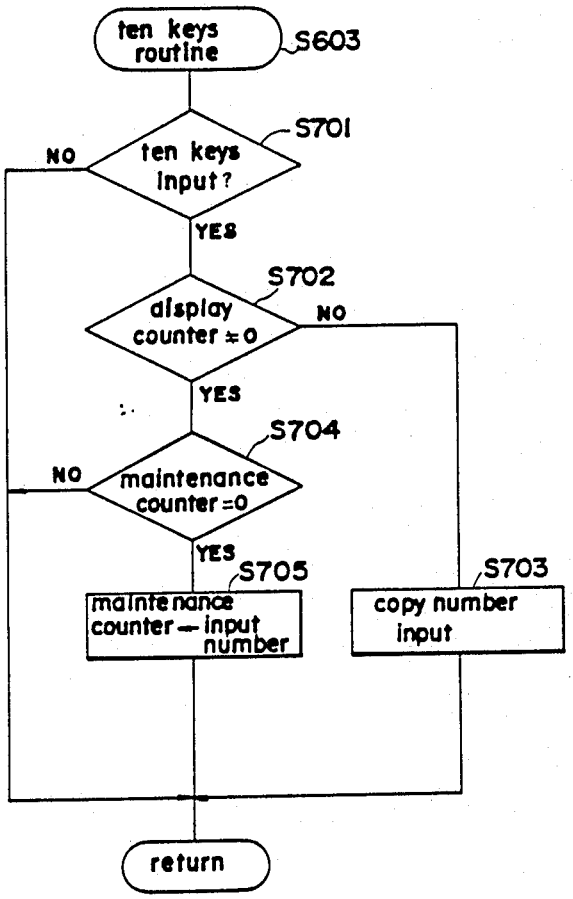
FIG. 32 is a flow chart showing details of the ten-key processing routine.

FIG. 32 is a flow chart showing details of the aforesaid ten-key routine (step S603). First, a determination is made as to whether or not there is input from any of the ten keys 51 to 60 (step S701), then with said key at ON-edge status, as illustrated in the drawing, the content of the "display counter flag" is determined (step S702). The flag is raised by the first-round input from the counter display request key 73, and lowered by the second-round input. When said display counter flag is set at "1," the maintenance counter value is displayed in the sequence display area formed by the copy magnification display section 118 and the copy number display section 101. Also, when display counter flag is set at "0," the ten-key input value is used s the copy number (step S703). In step S704, a determination is made as to whether or not the maintenance counter value is "0," and if so (i.e. if cleared as described hereinafter), the ten-key input value is received as the initial value as well as the maintenance counter value.

Figure 33:
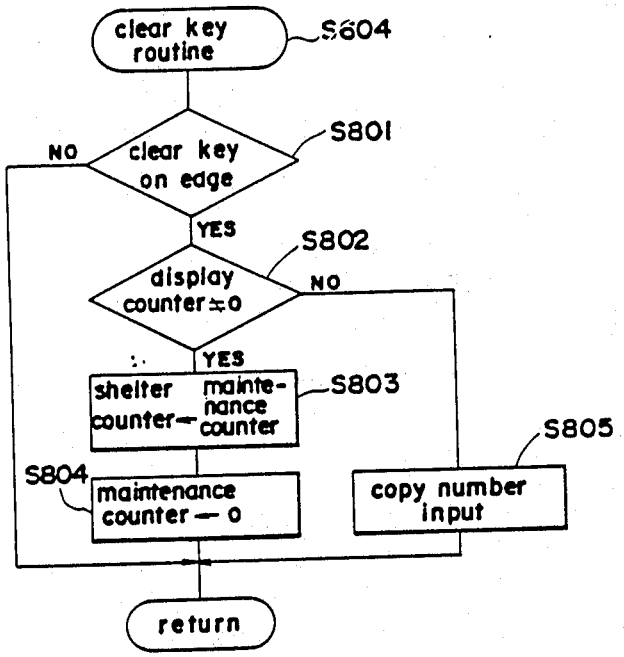
FIG. 33 is a flow chart showing details of the clear-key processing routine.

FIG. 33 is a flow chart showing details of the aforesaid clear key routine (step S604). A determination is made as to whether or not the display counter flag is set at "1" (steps S801 and S802) when the clear key 62 is at ON-edge status, as illustrated in the drawing. When the display counter flag is set at "1," the maintenance counter value is saved in the SAVE counter in step S803. This feature permit the original counter value to be recalled via the interrupt key described hereinafter when an erroneous value is input in step S701 of FIG. 32. Next, the maintenance counter value is set at "0" (step S804) and, if the display counter flag is "0," the copy number register is cleared (step S805) and the number display is set at 1.

Figure 34:
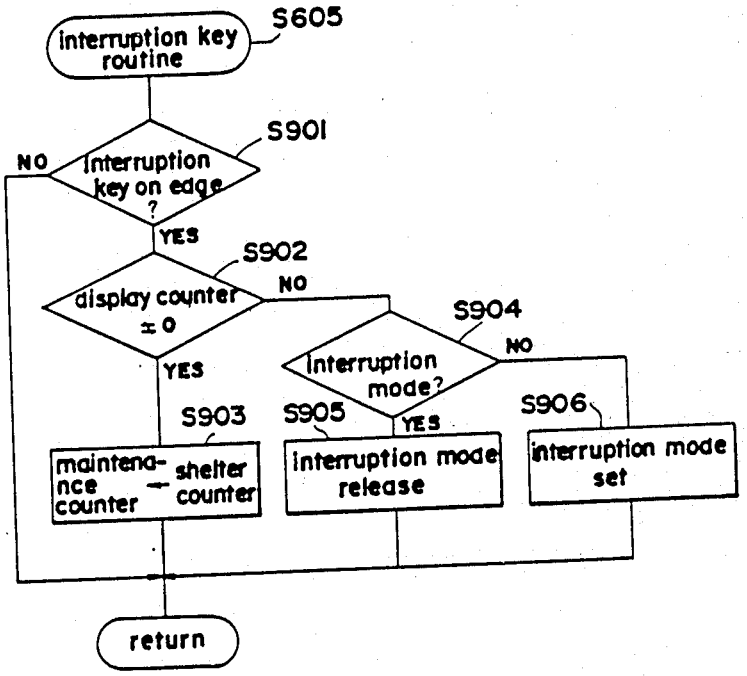
FIG. 34 is a flow chart showing details of the interrupt-key processing routine.

FIG. 34 is a flow chart showing the aforesaid interrupt key routine (step S605). As illustrated in the drawing, the content of the display counter flag is determined (step S902) when interrupt key 61 is at ON-edge status (step S901); when said counter flag is set at "1," the original counter value stored in the SAVE counter is displayed as the maintenance counter value (step S903). When the display counter flag is set at "0," however, a determination is made as to whether or not the interrupt mode is active (step S904); when said interrupt mode is active, the mode is cancelled (step S905). If said interrupt mode is not active, the mode is set (step S906).

Figure 35:
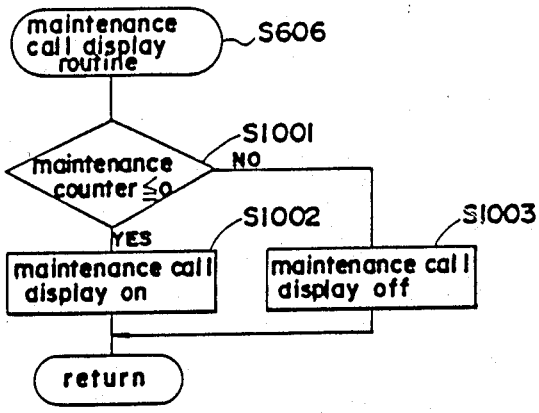
FIG. 35 is a flow chart showing details of the maintenance-call indicator processing routine.

FIG. 35 s a flow chart showing details of the previously described maintenance call routine. First, when the maintenance counter value is zero (0) or less, the maintenance call display (e.g., the service call mark 101a) is switched ON (steps S1001 and S1002). When the maintenance counter value is one (1) or less, however, the maintenance call display is OFF (step S1003).

Figure 36:
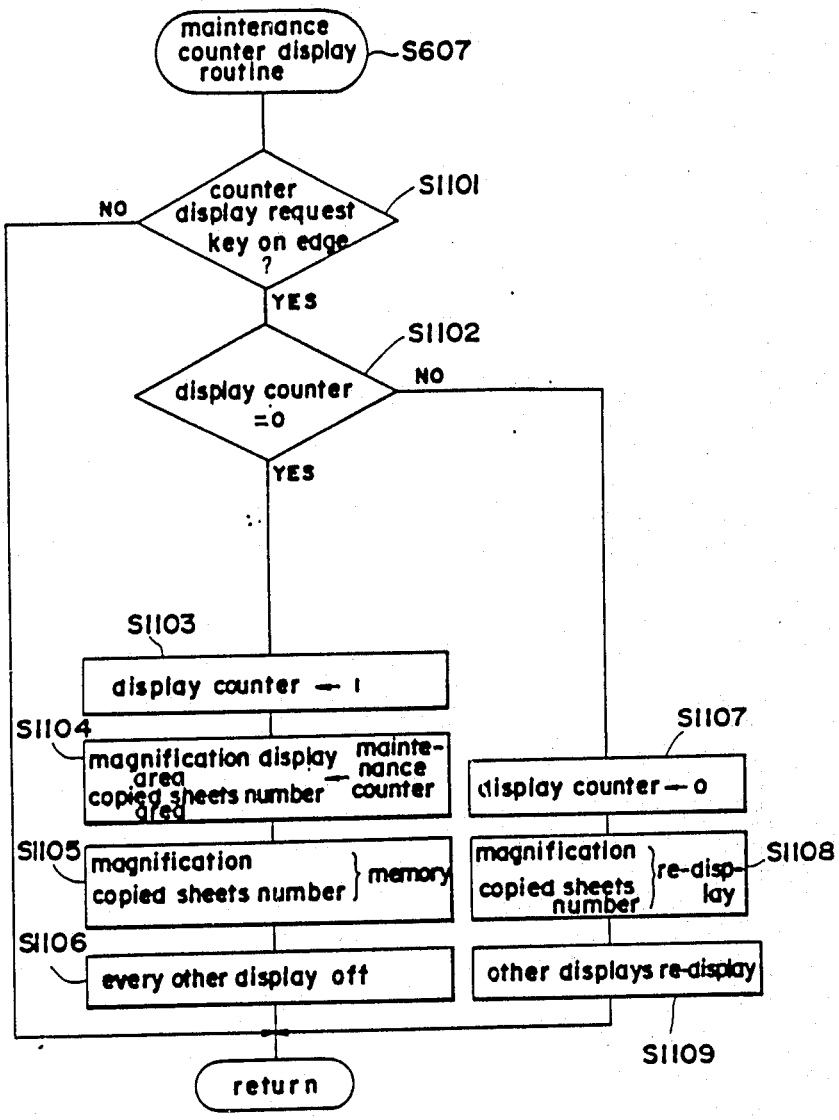
FIG. 36 is a flow chart showing details of the maintenance-counter indicator processing routine.

FIG. 36 is a flow chart showing details of the aforesaid maintenance counter display routine (step S607). First, the content of the display counter flag is determined (steps S1101 and S1102) while the counter display request key 73 is at ON-edge status. When said flag is set at "0," the maintenance counter value is displayed (step S1104) in the sequence display area formed by the copy magnification display section 118 and the copy number display section 101. Other display areas are also switched OFF at that time (step S1106). Additionally, the magnification and copy numbers, which are not displayed prior to the input from the counter display request key 63, are saved in the stack area of memory 213 (step S1105). On the other hand, when the display counter flag is set at "1" (step S1102), the flag is reset at "0" and the magnification and copy number are each recalled to the magnification display section 118 and copy number display section 101 and displayed, while the other display areas are switched OFF and cancelled (steps S1107 to S1109).

Figure 37:
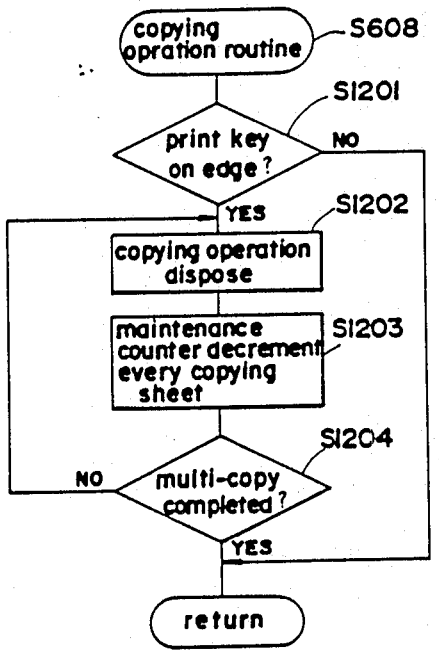
FIG. 37 is a flow chart showing a summary of the copy operation routine.

FIG. 37 is a flow chart briefly showing the copy operation routine (step S15).

First, the copy operation process is initiated (steps S1201 and S1202) by means of the ON-edge status of print key 50. The description of the process contained herein is abbreviated since details of copy operation processing are well known to those skilled in the art. In step S1203, the maintenance counter value is decremented with each single, copy, and the counter value continues to be decremented until the plurality of copies are completed (step S1204). This feature allows that a one-time exposure scanning completion to be made as a reference.

The aforesaid embodiment allows that service personnel may freely set the initial value for the maintenance counter to correspond with the characteristics of each machine. The maintenance counter also has the advantage of allowing consideration of a subsequent initial value for the maintenance counter because it functions as a subtractor-type counter when the counter value is zero (0) or less.

In addition, a standard maintenance value may be pre-set when the copy machine is being packaged at the factory for shipping.

In the aforesaid embodiment there is a single maintenance counter and the maintenance call display is also illuminated by a single service mark 104. A plurality of maintenance counters may be provided to each component part in the copy machine, however, with different displays for each.

While there has been described the preferred embodiments, modifications and variations being obvious to those skilled in the art are possible without departing from the spirit of the invention. The scope is therefore to be determined solely by the appended claims.

What is claimed is:

1. In a copying apparatus which includes one or more components to be replaced with new components at predetermined intervals, the apparatus including:
   - first counting means for counting a number of copies reproduced;
   - second counting means for counting use frequencies of said various components which are not counted by said first counting means;
   - memory means for saving the counted use frequency of said second counting means;
   - clearing means which clears the counted use frequency of the second counting means;
   - clear indicator means indicates which clearing of the counted use frequency of the second counting means;
   - cancellation display means which displays the cancelled clearing of the counted use frequency of the second counting means; and clearing control means which restores the saved use frequency to the second counting means following the cancellation of the clearing operation which is indicated by the cancellation display means after the clearing display indicates the clearing operation has been performed and the counted use frequency is saved in the memory means.

2. A copying apparatus as claimed in claim 1, wherein said clearing means includes a key which is located on an operation panel of the apparatus.

3. A copying apparatus as claimed in claim 2, wherein said clearing means includes a key which clears a copy number display, said copy number display normally displaying a set number of copies.

4. A copying apparatus as claimed in claim 1, further including, use frequency displaying means for displaying use frequency counted by said second counting means as well as a code representing the corresponding component.

5. A copying apparatus as claimed in claim 4, wherein said code representing the corresponding component is symbolic mark.

6. A copying apparatus as claimed in claim 4, wherein said use frequency displaying means displays the use frequency of said second counting means as well as the code representing the corresponding component before the clearing means clears the counted use frequency.

7. A copying apparatus as claimed in claim 4, wherein said use frequency displaying means displays the use frequency counted by said second counting means and the code representing the corresponding component in a combined manner on a copy number display and a copy magnification display, said copy number display normally displaying a set number of copies, and said copy magnification display normally displaying a set magnification of a copying operation.

8. A copying apparatus as claimed in claim 7, wherein said use frequency displaying means displays the use frequency of said second counting means continuously on said copy number display and copy magnification display.

* * * * *